US007104644B2

(12) United States Patent
Sugaya et al.

(10) Patent No.: US 7,104,644 B2
(45) Date of Patent: Sep. 12, 2006

(54) IMAGE RECORDING MEDIUM AND IMAGE RECORDING APPARATUS

(75) Inventors: Toyoaki Sugaya, Hachioji (JP); Tetsuo Uno, Suginami-ku (JP)

(73) Assignee: Konica Minolta Holdings, Inc., Tokyo (JP)

( * ) Notice: Subject to any disclaimer, the term of this patent is extended or adjusted under 35 U.S.C. 154(b) by 314 days.

(21) Appl. No.: 10/477,168

(22) PCT Filed: May 14, 2002

(86) PCT No.: PCT/JP02/04648

§ 371 (c)(1),
(2), (4) Date: Nov. 6, 2003

(87) PCT Pub. No.: WO02/092347

PCT Pub. Date: Nov. 21, 2002

(65) Prior Publication Data

US 2004/0169692 A1 Sep. 2, 2004

(30) Foreign Application Priority Data

May 16, 2001 (JP) ..... 2001-146424

(51) Int. Cl.
*B41J 2/01* (2006.01)

(52) U.S. Cl. ..... 347/107; 347/105; 347/19; 347/14

(58) Field of Classification Search ..... 347/105, 347/106, 14, 19; 428/32.1–32.3
See application file for complete search history.

(56) References Cited

U.S. PATENT DOCUMENTS

| | | | | |
|---|---|---|---|---|
| 6,712,446 | B1 * | 3/2004 | Huffman | 347/19 |
| 2002/0085052 | A1 * | 7/2002 | Danzuka | 347/9 |
| 2003/0067504 | A1 * | 4/2003 | Spurr et al. | 347/19 |
| 2003/0072922 | A1 * | 4/2003 | Haines | 428/195 |

FOREIGN PATENT DOCUMENTS

| | | | |
|---|---|---|---|
| EP | 884195 | A1 * | 12/1998 |
| JP | 2-208048 | A | 8/1990 |
| JP | 5-301339 | A | 11/1993 |
| JP | 7-060969 | A | 3/1995 |
| JP | 8-258252 | A | 10/1996 |
| JP | 9-039268 | A | 2/1997 |
| JP | 9-093448 | A | 4/1997 |
| JP | 9-164702 | A | 6/1997 |
| JP | 9-286123 | A | 11/1997 |
| JP | 2000-158680 | A | 6/2000 |
| JP | 3075440 | U | 11/2000 |
| JP | 2001-005931 | A | 1/2001 |
| JP | 2001-270192 | A | 10/2001 |

* cited by examiner

*Primary Examiner*—Stephen Meier
*Assistant Examiner*—Ly T. Tran
(74) *Attorney, Agent, or Firm*—Frishauf, Holtz, Goodman & Chick, P.C.

(57) ABSTRACT

An image recording medium used for an image recording apparatus having a recording head for recording an image on the image recording medium. The image recording apparatus is provided an information recording section in which information relating to the image recording medium is recorded.

10 Claims, 18 Drawing Sheets

FIG. 25 ( a )
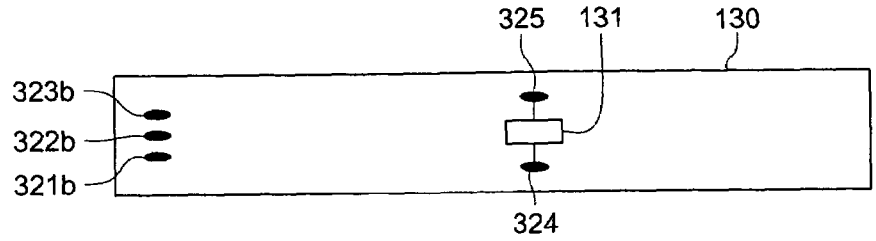
FIG. 25 ( b )
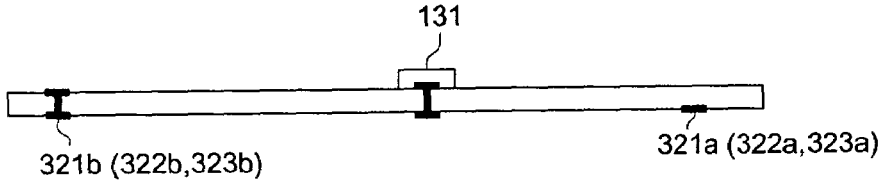
FIG. 25 ( c )
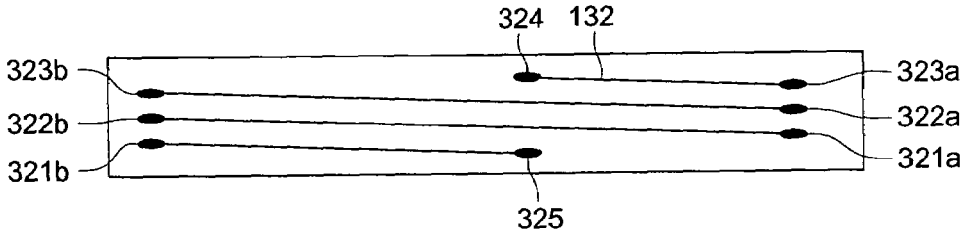
FIG. 26
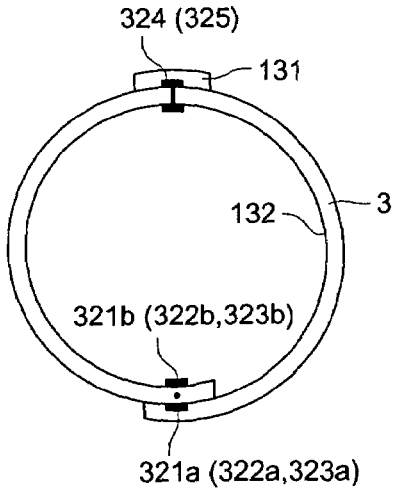

IMAGE RECORDING MEDIUM AND IMAGE RECORDING APPARATUS

This application is a U.S. National Phase Application under 35 USC 371 of International Application PCT/JP02/04648 filed May 14, 2002.

TECHNICAL FIELD

The present invention relates to an image recording medium in which the information relating to a recording medium is recorded, and to an inkjet recording apparatus which is provided with a means by which the ink is jetted onto the image recording medium and an image is recorded, and the information recording and reading are conducted on the image recording medium.

BACKGROUND TECHNOLOGY

The inkjet recording method is a method by which the minute ink droplet is jetted, and a dot is formed by adhering it to the recording medium such as the paper, and an image and character are recorded. Because it causes low noise and does not require a process such as the developing or fixing, and a full-color recording can be easily conducted, it is rapidly spread to various fields such as each kind of printer, facsimile, and computer terminal.

Particularly, recently, like as an increase of the speed of the apparatus, an increase of a high minuteness or an increase of a high image quality full color, improvement of performance of the inkjet recording apparatus in which the inkjet recording method is adopted is accelerated, and together with this, in the recording media used for the inkjet recording apparatus, various kinds of recording media are used. Accordingly, for these various kinds of recording medium, the inkjet recording apparatus by which respectively under the optimum condition, recording can be conducted is required.

Generally, as the characteristic of the recording medium which is required for conducting the high quality recording, the ink absorption characteristic such as the maximum ink absorption amount of the recording medium, the ink absorption speed, the ink drying time, and the ink dot diameter, can be listed.

The maximum ink absorption amount is a parameter required when the ink jetting amount per unit area jetted onto the recording medium is controlled. When, onto the recording medium, the ink more than the maximum ink absorption amount is jetted, the ink amount becomes excessive, and the ink overflows from the surface, and the phenomena of bleeding is generated. Inversely, when, to the ink absorption amount, the image is formed by the smaller amount of ink, a problem is generated like that the image density is lowered, and the quality of the image is lowered. Therefore, it is necessary that, according to the ink absorption amount, the ink jetting amount per unit area is adequately controlled.

Further, the ink absorption speed is a parameter necessary when the ink jetting amount per unit time which is jetted onto the recording medium is controlled. When the recording is conducted at a pace more than the ink absorption speed, before the first ink droplet is absorbed in the recording medium, the next ink droplet is jetted, and in this case, the ink droplets are fused into one and becomes a large ink droplet, and a problem that it is jointed to the adjoining ink dot is generated. Accordingly, it is necessary that the ink jetting amount per unit time is adequately controlled according to the ink absorption speed of the recording medium.

Then, the ink drying time is a parameter necessary when the recording time interval at the time of continuous recording is controlled. When the recording is conducted at the faster pace not larger than the ink drying time, before the ink on the recording surface of the recording medium is perfectly dried, the next image is outputted, and a problem that the ink is transferred between recording media stacked on the ejection sheet tray, or an image is disturbed by the scuffing, is generated. Accordingly, it is necessary that the recording interval time is adequately controlled according to the ink drying time of the recording medium.

Further, the ink dot diameter is a parameter which is necessary when the ink jetting amount per unit area which is jetted onto the recording medium is controlled. The ink jetting amount per unit area called herein is to be determined by a volume of the jetted ink droplets and a specified resolving power. When the volume of the ink droplet is larger than the necessary one, or the resolving power is set higher than the necessary one, the adjoining ink dots are jointed and a problem of the lowering of the image quality is generated. Further, when the volume of the ink droplet is too little, the image density is lowered, and the quality of the image is deteriorated. Accordingly, to the ink dot diameter, it is necessary that the ink jetting amount per unit area (the volume of the jetted ink droplet and the set resolving power) is adequately controlled.

As described above, in such an inkjet recording apparatus, in order to conduct the recording of the high quality onto the various kinds of recording media, corresponding to the ink absorption characteristic of the recording medium such as the ink absorption amount of the recording medium, ink absorption speed, ink drying time, and ink dot diameter, the necessity that the recording is adequately conducted, is generated.

However, in the conventional inkjet recording apparatus, in order to correspond to these various kinds of recording media, for example, operations by which the optimum condition is set again, are necessary every when the recording medium is changed. These operations require a long time period, and it is also a cause for generating a problem such as a mis-setting. Undoubtedly, in the conventional inkjet recording apparatus, there exist apparatus which record under several ways of recording conditions corresponding to the characteristic of the recording medium, however, these are apparatus which are considered so that, to absolutely limited several kinds of recording media, it corresponds only relating to the conditions in which the quality of paper is limited, and naturally, it can not correspond to the various kinds of recording media in the recent years. Then, it can not correspond to complicated conditions such as the ink absorption amount, ink absorption speed, ink drying time, and ink dot diameter.

Further, the ink used in the inkjet recording apparatus, is largely separated into the dye ink and the pigment ink. The dye ink is soluble in the solvent, and shows a highly pure and clear coloring, further, since it does not generate the scattering light and reflected light because of no granularity, the transparency is high and the hue is clear, however, on the one hand, when the pigment molecule is destroyed by the photochemical reaction, since the decrease of the number of molecules directly influence the coloring density, there is a problem that the light stability is poor.

In contrast to this, the pigment ink is insoluble in the solvent, and the pigment molecules form the particle and contribute to coloring under the situation that the particle is dispersed in the solvent, and even when the molecule of the surface is destroyed by the photochemical reaction, because there is a new pigment molecule layer under it, there is an advantage that the apparent decrease of coloring power is small and the image storage stability is more excellent comparing to the dyet ink.

However, there is a problem in the pigment ink that the glossiness is poor by the influence of the scattered light and reflected light caused by the particle of the pigment ink. Therefore, in order to give glossiness to the recording medium surface, on which an image is recorded and formed by using the pigment ink including dispersing agent, and in order to prevent the bleeding of the image by contact with the water, and together with that, in order to increase the abrasion-resistance, a technology id proposed that the image is recorded and formed by using the recording medium having the ink receiving layer including the thermoplastic resin particles and the pigment ink solvent absorption layer adjoining to the inside of the ink receiving layer on the surface layer (image recording surface side), and after that, when the recording medium is heated and pressed, the thermoplastic resin particles in the ink receiving layer are fused and smoothed, and the ink receiving layer is cleared (Japanese Patent Application No. 2000-164386).

In such technology, the recording medium on which the image is recorded and formed by the recording head, is conveyed to the heat and pressure means by the transportation means, and heated and pressed and the ink receiving layer is made transparent, then, in order to make a high quality image print, it is necessary that the making transparent of this ink receiving layer is adequately conducted.

Accordingly, in the conventional inkjet recording apparatus, the recording medium on which the recording is conducted is previously specified, and when the optimum heating and pressing condition corresponding to the characteristic of the recording medium is set in the inkjet recording apparatus, it is realized that the high quality image print is produced.

However, in the recent years, various kinds of recording media are appeared also in the recording media having the thermoplastic resin layer on this surface layer, and in the conventional inkjet recording apparatus, in order to correspond to these recording media, it is necessary that the optimum heating and pressing condition is respectively set. This setting is a very troublesome operation, and it is also a cause to generate the mis-setting. Certainly, in the conventional inkjet recording apparatus, there exist apparatus by which the recording is conducted under several recording conditions corresponding to the characteristic of the recording medium, however, they are apparatus which are absolutely considered so as to correspond to the conditions of the paper quality of the recording medium, and they are not the apparatus corresponding to the heating and pressing conditions of the above-described recording medium having the thermoplastic resin layer on the surface layer.

Further, in the inkjet image recording apparatus, corresponding to the characteristic of the recording medium used for recording the high image quality image, the jetting amount of the ink, or the transportation amount for transporting the recording medium, the distance between the recording medium and the recording head, or the recording speed are controlled.

In the inkjet image recording apparatus as described above, it is necessary that the characteristic of the recording medium is detected in order to record the high image quality image on the recording medium. Further, it is also necessary that the residual amount of the roll-like image recording medium is detected.

The conventional method by which the information of the roll-like image recording medium is detected in the inkjet image recording apparatus as described above, is disclosed in Japanese Tokkaihei No. 4-51184. According to this, in the detection method of the information of the recording medium, the information of the recording medium is recorded on the core member of the roll-like recording medium and this information is detected by an optical sensor. Further, in this image recording apparatus, only the reading of the information of the recording medium is conducted.

Hereupon, as the method to detect the residual amount of the roll-like image recording medium, there is a method by which a mark is used on the trailing edge portion of the recording medium, or a method by which the residual amount is calculated from an initial amount and a used amount of the recording medium. However, there is a problem that the mid-flow using condition such as a residual amount of the recording medium is unknown, when, on the mid-flow of use of the recording medium, it is exchanged with the roll-like recording medium having another characteristic, and the roll-like recording medium is held in the image recording apparatus for the re-use.

Further, in the image recording apparatus, it is controlled in such a manner that the recording image becomes the high quality according to the characteristic of the recording medium, however, when the kind of the recording medium does not conform to the image recording apparatus, the high quality recording of the recording image can not be conducted.

Further, in the inkjet image recording apparatus, there is also an apparatus by which, in order to make the recording image high quality and the color gradation of the recording image optimum, the test pattern is recorded on the recording medium, and the recorded color gradation is measured, and color correction by calculating the color gradation correction curve is conducted. However, when the recording medium is exchanged with the image recording medium having another characteristic on the mid-flow of use and the image recording medium which is on the mid-flow of use is held in the image recording apparatus again for the re-use, it is necessary that the color correction is conducted every when the image recording medium is exchanged. From this reason, there is a waste in the recording medium or in time.

As described above, in the image recording apparatus, in the case where the image recording medium whose kind or characteristic is different is exchanged and used if necessary, when it is exchanged with the image recording medium whose kind or characteristic is different on the mid-flow of use, the information such as residual amount or characteristic relating to the use of the image recording medium which is used heretofore, that is, the information accumulated in the image recording apparatus is lost when it is disengaged from the image recording apparatus. Thereby, when the recording medium is held again in the image recording apparatus for re-use, because, in the image recording apparatus, the information of the image recording medium before the exchange becomes unknown, a waste of the recording medium due to the shortage such as the residual amount, or a waste of the time such as for the re-attempt of the color correction is generated.

Accordingly, the first object of the present invention is, in an inkjet recording apparatus by which the information showing the ink absorption amount, ink absorption speed, ink drying time, and ink dot diameter, which are the ink absorption characteristic, is previously recorded in the recording medium, and the recording is conducted in the recording medium, when the information is read and on the basis of the information, the recording is adequately conducted, to provide an inkjet recording medium and an inkjet recording apparatus by which it is realized that it corresponds also to recent various kinds of recording media, and produces the high quality image print.

The second object of the present invention is, in the inkjet recording apparatus by which the information showing the heating and/or pressing condition corresponding to its characteristic is previously recorded in the recording medium containing the thermoplastic resin particle on the surface layer and the recording is conducted in the recording medium, when the information showing the heating and/or pressing condition is read, and the heating and/or pressing processing is conducted under the heating and/or pressing condition, to provide the inkjet recording medium and the inkjet recording apparatus by which it is realized that it corresponds also to a plurality of kinds of recording media and produces the high quality image print.

The third object of the present invention is to provide an image recording medium by which the information relating to the image recording medium can be accurately detected, and the information relating to the use of the recording medium can be written and renewed, and to provide the image recording apparatus provided with an access means by which the information relating to the recording medium of the image recording medium can be read and written. Further, it is to provide the image recording apparatus provided with also the distinguish means for adaptation-judging the recording medium to the image recording apparatus.

The further object of the present invention is to provide the image recording medium by which the information relating to the image recording medium can be exactly detected, and the information relating to the use of the recording medium or the color correction information can be written and renewed, and to provide the image recording apparatus provided with an access means by which the information relating to the recording medium of the image recording medium can be read and written, and provided with the function by which the color correction can be conducted.

DISCLOSURE OF THE INVENTION

The above-described objects can be attained by the following means.

(1) An inkjet recording medium for being used for an inkjet recording apparatus which conducts recording by jetting an ink onto the recording medium, characterized in that information relating to an ink absorption characteristic is previously recorded in the recording medium.

(2) An inkjet recording medium accommodated in an accommodating member, for being used for an inkjet recording apparatus which conducts recording by jetting an ink onto the recording medium, characterized in that information relating to an ink absorption characteristic is previously recorded in the accommodating member.

(3) An inkjet recording medium rolled on a core member, for being used for an inkjet recording apparatus which conducts recording by jetting an ink onto the recording medium, characterized in that information relating to an ink absorption characteristic is previously recorded in the core member.

(4) The inkjet recording apparatus is characterized in that: the inkjet recording medium described in (1) to (3) is used, and the information relating to the ink absorption characteristic of the recording medium is the ink absorption amount relating to the recording medium and/or ink absorption speed and/or ink drying time and/or ink dot diameter.

(5) The inkjet recording apparatus having at least a recording head by which the ink is jetted onto the recording medium and the recording is conducted, and a sensor by which the information relating to the ink absorption characteristic of the recording medium which is previously recorded on the recording medium, or the core member of the recording medium, or accommodating member of the recording medium, is read, the inkjet recording apparatus is characterized in that: on the basis of the information the information relating to the ink absorption characteristic which is read by the sensor, the set condition when the recording is conducted, is controlled.

(6) The inkjet recording apparatus is the inkjet recording apparatus written in (5), and characterized in that: the setting condition when the recording is conducted is an ink jetting amount per unit area which is jetted onto the recording medium and/or ink jetting amount per unit time and/or the recording interval time when the recording is continuously conducted.

(7) The inkjet recording apparatus is the inkjet recording apparatus written in (5) and (6), and in the inkjet recording apparatus having at least a recording head by which the ink is jetted onto the recording medium and the recording is conducted, and a sensor by which the information relating to the ink absorption characteristic of the recording medium which is previously recorded on the recording medium, the core member of the recording medium or the accommodating member of the recording medium is read, it is characterized in that: on the basis of the information relating to the ink absorption amount read by the sensor, the ink jetting amount per unit area for the predetermined input data is controlled.

(8) The inkjet recording apparatus is the inkjet recording apparatus written in (5) and (6), and in the inkjet recording apparatus having at least a recording head by which the ink is jetted onto the recording medium and the recording is conducted, and a sensor by which the information relating to the ink absorption characteristic of the recording medium which is previously recorded on the recording medium, the core member of the recording medium or the accommodating member of the recording medium is read, it is characterized in that: on the basis of the information relating to the ink absorption speed read by the sensor, the ink jetting amount per unit time for the predetermined input data is controlled.

(9) The inkjet recording apparatus is the inkjet recording apparatus written in (5) and (6), and in the inkjet recording apparatus having at least a recording head by which the ink is jetted onto the recording medium and the recording is conducted, and a sensor by which the information relating to the ink absorption characteristic of the recording medium which is previously recorded on the recording medium, the core member of the recording medium or the accommodating member of the recording medium is read, it is characterized in that: on the basis of the information relating to the ink dot diameter read by the sensor, the ink jetting amount per unit area for the predetermined input data, particularly, the ink droplet volume or recording density is controlled.

(10) The inkjet recording apparatus is the inkjet recording apparatus written in (5) and (6), and in the inkjet recording apparatus having at least a recording head by which the ink is jetted onto the recording medium and the recording is conducted, and a sensor by which the information relating to the ink absorption characteristic of the recording medium which is previously recorded on the recording medium, the core member of the recording medium or the accommodating member of the recording medium is read, it is characterized in that: on the basis of the information relating to the ink drying time read by the sensor, the recording interval time when the recording is continuously conducted is controlled.

(11) In the inkjet recording medium having the thermoplastic resin containing layer on the surface layer, the inkjet recording medium is characterized in that: the information showing the heating and/or pressing condition is previously recorded.

(12) The inkjet recording medium is the inkjet recording medium written in (11), and is characterized in that: the recording medium is wound to form a roll, and on the side surface portion of the roll the information showing the heating and/or pressing condition is previously recorded.

(13) In the inkjet recording medium having the thermoplastic resin containing layer on the surface layer, the inkjet recording medium is characterized in that: the recording medium is wound around the core member and on the core member, the information showing the heating and/or pressing condition is previously recorded.

(14) In the inkjet recording medium having the thermoplastic resin containing layer on the surface layer, the inkjet recording medium is characterized in that: the recording medium is accommodated in the accommodating member, and on the accommodating member, the information showing the heating and/or pressing condition is previously recorded.

(15) In the inkjet recording apparatus having a recording head by which the ink is jetted onto the recording medium having the thermoplastic resin containing layer on the surface layer and the recording is conducted, and a transportation means for transporting the recording medium, and a heating and pressing section for conducting the heating and pressing processing on the recording medium after the recording, the inkjet recording apparatus is characterized in that: it has a sensor which reads the information showing the heating and/or pressing condition, which is previously recorded in the recording medium, and a control means for controlling the heating and/or pressing condition on the basis of the information from the sensor.

(16) The inkjet recording apparatus is the inkjet recording apparatus written in (15), and is characterized in that: the recording medium is wound roll-like, and the information showing the heating and/or pressing condition is previously recorded on the side surface portion of the roller.

(17) In the inkjet recording apparatus having a recording head for jetting the ink onto the recording medium which is wound around the core member and has the thermoplastic resin containing layer on the surface layer, and for conducting the recording, a transportation means for transporting the recording medium, and a heating and pressing section for conducting the heating and pressing processing on the recording medium after the recording, the inkjet recording apparatus is characterized in that: it has a sensor for reading the information showing the heating and/or pressing condition which is previously recorded on the core member, and a control means for controlling the heating and/or pressing condition based on the information from the sensor.

(18) In the inkjet recording apparatus having a recording head for jetting the ink onto the recording medium which is accommodated in an accommodating member and has the thermoplastic resin containing layer on the surface layer, and for conducting the recording, a transportation means for transporting the recording medium, and a heating and pressing section for conducting the heating and pressing processing on the recording medium after the recording, the inkjet recording apparatus is characterized in that: it has a sensor for reading the information showing the heating and/or pressing condition which is previously recorded on the accommodating member, and a control means for controlling the heating and/or pressing condition based on the information from the sensor.

(19) An image recording medium used for the image recording apparatus which conducts the recording of the image by using the recording head, and is characterized in that: it has a holding member for holding the image recording medium, and a non-volatile memory in which the information relating to the recording medium is recorded, is provided to the holding member.

(20) The image recording medium is the image recording medium of (19), and is characterized in that: the holding member is a core member around which the recording medium is wound, and by which it is held, and this core member is composed of a portion which holds the recording medium and is rotated, and a fixed portion which supports it, and on this fixed portion, the non-volatile memory is provided.

(21) The image recording medium is the image recording medium which is used for the image recording apparatus which uses the recording head and conducts the recording of the image, and is characterized in that: it has an accommodating member for accommodating the image recording medium, and to the accommodating member, the non-volatile memory in which the information relating to the recording medium is recorded is provided.

(22) The image recording medium is the image recording medium of any one of (19) to (21), and is characterized in that: the non-volatile memory is RFID.

(23) The image recording medium is the image recording medium of any one of (19) to (22), and is characterized in that: the information relating to the recording medium is the information relating to a residual amount or a used amount of the recording medium.

(24) The image recording medium is the image recording medium of any one of (19) to (22), and is characterized in that: the information relating to the recording medium is the information relating to the color correction of the recording medium.

(25) The image recording apparatus is an image recording apparatus by which the recording of the image is conducted on the image recording medium by using the recording head, and is characterized in that: it has the holding member for holding it, and the non-volatile memory in which the information relating to the recording medium is recorded, is provided to the holding member.

(26) The image recording apparatus is the image recording apparatus by which the recording of the image is conducted on the image recording medium by using the recording head, and is characterized in that: the non-volatile memory in which the information relating to the recording medium is recorded, is provided to the core member around which the image recording medium is wounded and by which it is held, and a memory access means for conducting the writing and reading of the information to the non-volatile memory is provided.

(27) The image recording apparatus is the image recording apparatus by which the recording of the image is conducted on the image recording medium by using the recording head, and is characterized in that: the non-volatile memory in which the information relating to the image recording medium is recorded, is provided to the accommodating member in which the image recording medium is accommodated, and a memory access means for conducting the writing and reading of the information to the non-volatile memory is provided.

(28) The image recording apparatus is the image recording apparatus of any one of (25) to (27) and by which the recording of the image is conducted by using the recording head on the image recording medium, and is characterized in that: the non-volatile memory in which the information relating to the image recording medium is recorded, is provided to the holding member for holding the image recording medium, and a display means for displaying the information relating to the image recording medium which is read from the non-volatile memory by the memory access means is further provided to the holding member for holding the image recording medium.

(29) The image recording apparatus is the image recording apparatus of any one of (25) to (28) and by which the recording of the image is conducted by using the recording head on the image recording medium, and is characterized in that: the non-volatile memory in which the information relating to the image recording medium is recorded, is provided to the holding member for holding the image recording medium, and it is discriminated based on the information relating to the image recording medium which is read from the non-volatile memory by the memory access means whether the image recording medium is adapted to the image recording apparatus, and when it is not adapted, a means for controlling so that the recording of the image is not conducted, is further provided.

(30) The image recording apparatus is the image recording apparatus of any one of (25) to (29), and the information relating to the residual amount of the image recording medium is recorded in the non-volatile memory, and is characterized in that: a renewing means for renewing the information of the non-volatile memory corresponding to the used amount of the recording medium is further provided.

(31) The image recording apparatus is the image recording apparatus of any one of (25) to (29), and the information relating to the initial amount and the used amount of the image recording medium is recorded in the non-volatile memory, and is characterized in that: a renewing means for renewing the used amount corresponding to the use of the recording medium is further provided.

(32) The image recording apparatus is the image recording apparatus by which the recording of the image is conducted by using the recording head on the image recording medium, and is characterized in that: it has a non-volatile memory in which the information relating to the image recording medium is recorded, on the holding member for holding the image recording medium, and a color correction-use test pattern generator and a color characteristic measuring means for measuring the color characteristic of the image recording medium in which the test pattern is recorded, and a color correction means for generating the color correction information referring to the color information measured by the measuring means, are provided, and the color correction information is recorded in the non-volatile memory, and a color correction means for conducting the color correction of the image recording information based on the color correction information recorded in the non-volatile memory, is provided.

(33) The image recording apparatus is the image recording apparatus of (32), and is characterized in that: a means for re-writing the color correction information is further provided.

(34) The image recording apparatus is the image recording apparatus of (25) to (33), and is characterized in that: the non-volatile memory is RFID.

BRIEF DESCRIPTION OF THE DRAWINGS

FIG. 14 is a view showing another example of the inkjet recording apparatus according to the present invention and an inkjet recording medium used for that.

FIG. 15 is a partially enlarged view expressing the basic structure of the inkjet recording apparatus according to the present invention and the inkjet recording medium used for that.

FIG. 16 is a partially enlarged view expressing the basic structure of the inkjet recording apparatus according to the present invention and the inkjet recording medium used for that.

FIG. 25(*a*) to FIG. 25(*c*) are views showing the structure of the RFID film of the present invention.

FIG. 26 is a sectional view in which the RFID film is arranged on the roller core member of the image recording medium.

BEST MODE TO CARRY OUT THE INVENTION

The mechanical structure and control structure in an image recording medium and image recording apparatus according to the present invention will be detailed below.

EMBODIMENT 1 OF THE INVENTION

Figure 1:
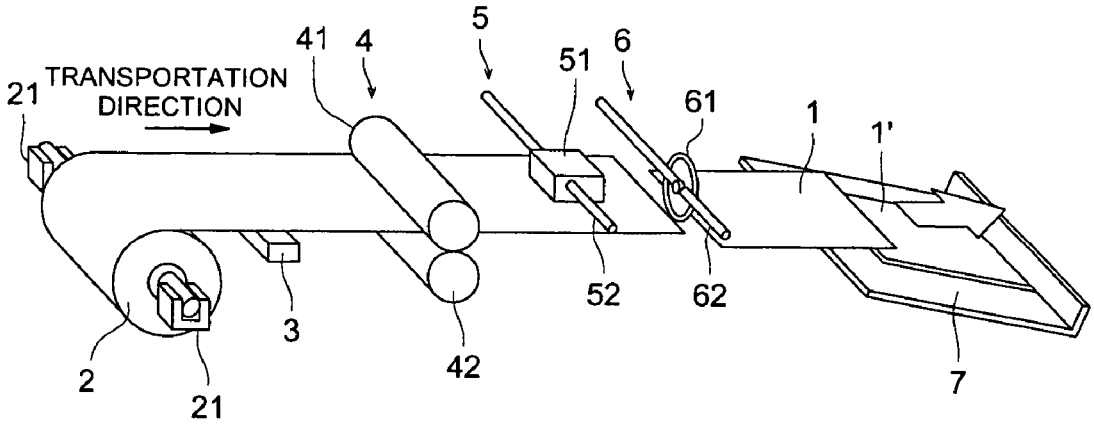
FIG. 1 is an overall view expressing the basic structure of an inkjet recording apparatus according to the present invention.

As shown in FIG. 1, an inkjet recording apparatus according to the present invention is structured, mainly, by a recording medium supporting portion 21 for supporting a master roll 2 of a recording medium 1, reading sensor 3 provided in its vicinity, recording medium transportation means 4 which is a means for transporting the recording medium 1, and composed of a transportation roller 42 and driven roller 41, recording section 5 composed of a recording head 51 and guide 52, cutting section 6 composed of a cutter 61 and a guide 62, sheet ejection tray 7 for stocking the recording medium 1 after the recording and cutting, and control structural section 8, not shown, for controlling them.

The recording medium 1 is pulled out from the master roll 2 by the recording medium transportation means 4, and after the information 11 relating to the ink absorption characteristic of the recording medium is read by the reading sensor 3, it is recorded by the recording head 51 in the recording section 5. This recording head 51 is structured so that it can reciprocally move on the recording medium along the guide 52. The recording medium 1 after the recording is cut into a predetermined size by the cutter 61 in the cutting section 6 provided at the downstream in its transportation direction. The cutter 61 is structured so that it can reciprocally move on the recording medium 1 along the guide 62. The recording medium 1 which is cut into a desired size in the cutting section 6, is delivered to the sheet ejection tray 7.

Figure 2:
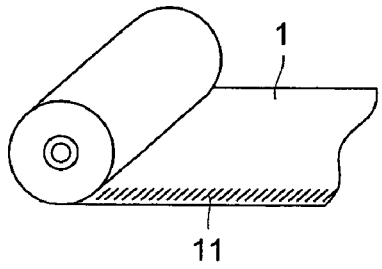
FIG. 2 is a view showing a recording medium used for the inkjet recording apparatus shown in FIG. 1.
Figure 3:
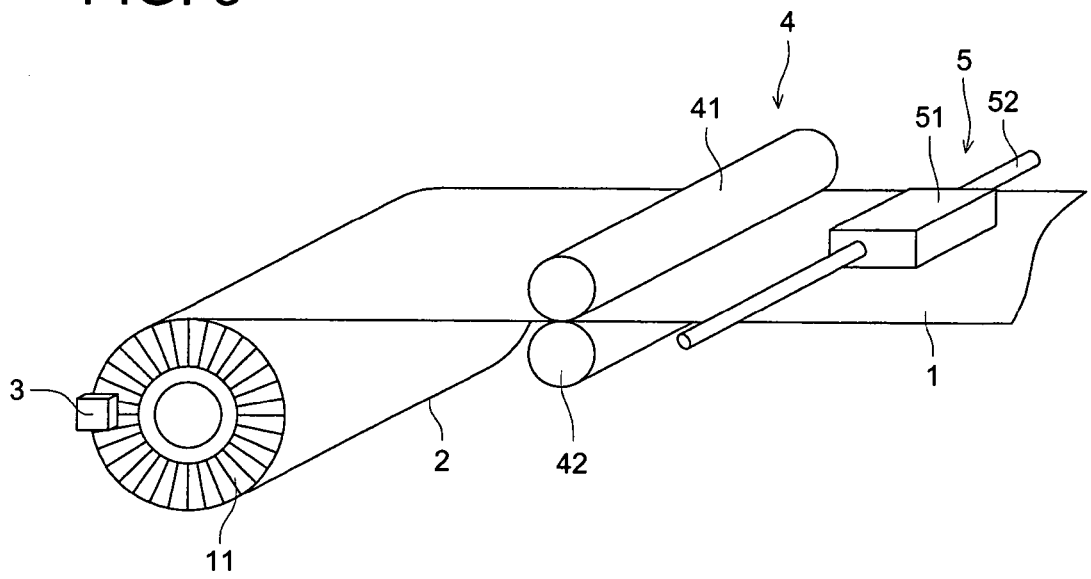
FIG. 3 is a view showing another example of the inkjet recording medium and inkjet recording apparatus according to the present invention.

As shown in FIG. 2, in the vicinity of the end portion of the recording medium, the information 11 relating to the ink absorption characteristic of the recording medium is recorded by using, for example, a bar-code, and a mechanism is structured in such a manner that, when the recording medium 1 pulled out from the master roll 2 by the recording medium transportation means 4, passes the vicinity of the reading sensor 3 using, for example, a reflection photo sensor, the information 11 is read. Hereupon, the information 11 relating to the ink absorption characteristic of the recording medium, may also be recorded in the side surface portion of the master roll 2, as shown in FIG. 3. In this case, the reading sensor 3 is provided in its vicinity. In this manner, when the information 11 relating to the ink absorption characteristic of the recording medium is recorded in the side surface portion of the master roll 2, the information 11 relating to the ink absorption characteristic of the recording medium can be recorded in the recording medium 1 at a low cost.

Figure 4:
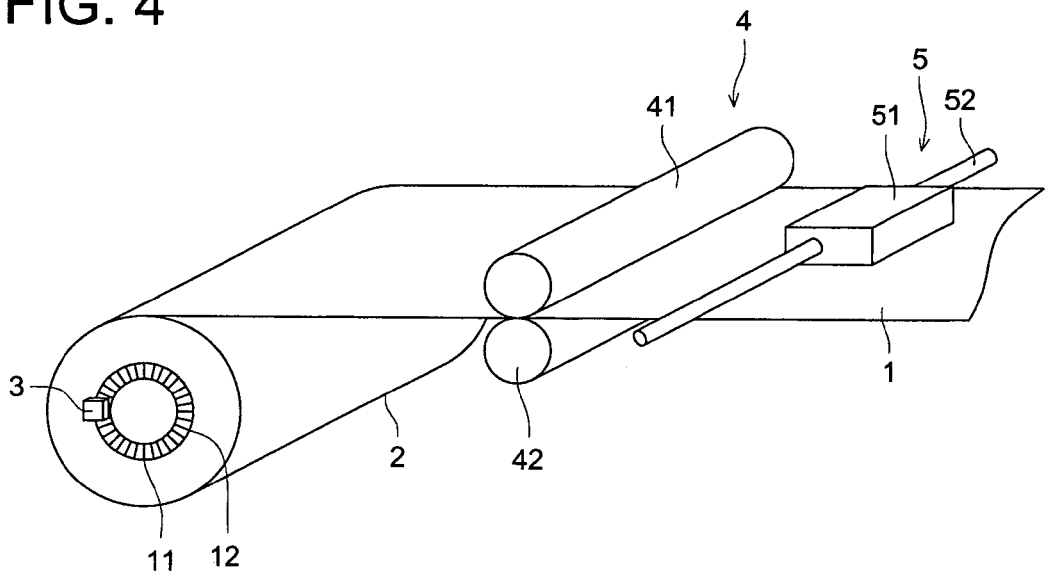
FIG. 4 is a view showing yet another example of the inkjet recording medium and inkjet recording apparatus according to the present invention.
Figure 5:
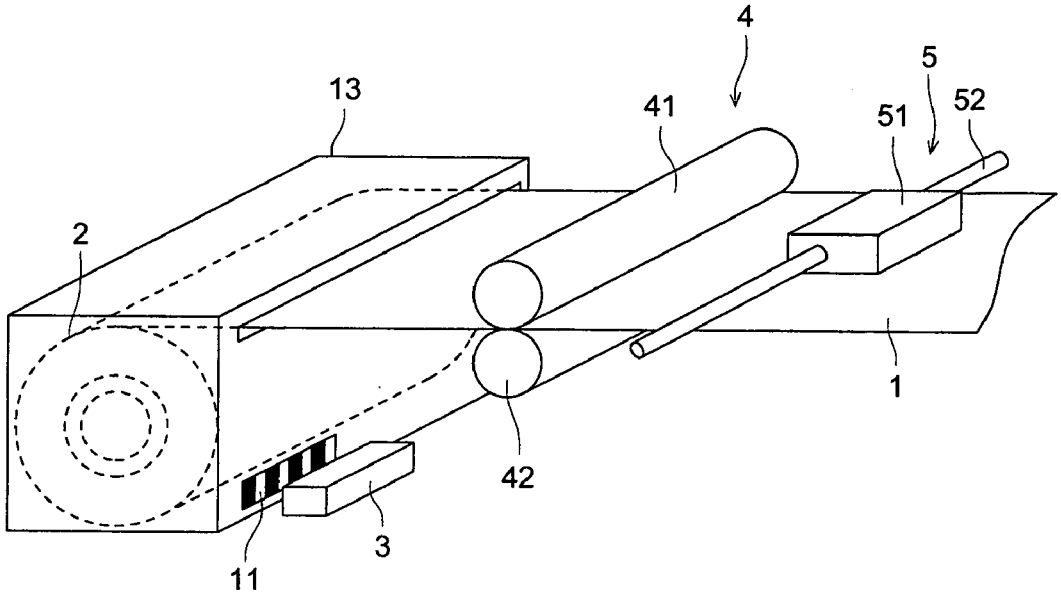
FIG. 5 is a view showing yet further and another example of the inkjet recording medium and inkjet recording apparatus according to the present invention.

In FIG. 4 and FIG. 5, another example of the recording method of the information 11 relating to the ink absorption characteristic of the recording medium and its reading method will be shown.

As shown in FIG. 4, the inkjet recording medium 1 in the present example is wound around the core member 12, and on the end portion of the core member, the information 11 relating to the ink absorption characteristic of the recording medium is recorded. Further, in its vicinity, the reading sensor 3 for reading the information 11 is provided. In the recording medium 1, the information 11 relating to the ink absorption characteristic of the recording medium is read by the reading sensor 3, and under the control which will be described later, the adequate recording is conducted.

As described above, when the information relating to the ink absorption characteristic of the recording medium is recorded in the core member around which the recording medium is wound, the recording medium itself is not stained and even when it is the recording medium of mid-flow of use, the information can be read and used.

As shown in FIG. 5, the inkjet recording medium 1 in the present example is accommodated in the accommodating member 13, and the information 11 relating to the ink absorption characteristic of the recording medium is previously recorded on the outer wall of the accommodating member 13. Further, in its vicinity, the reading sensor 3 for reading the information 11 is provided. In the recording medium 1, the information 11 relating to the ink absorption characteristic of the recording medium is read by the reading sensor 3, and under the control which will be described later, the adequate recording is conducted.

As described above, when the information relating to the ink absorption characteristic of the recording medium is recorded on the outer wall of the accommodating member for accommodating the recording medium, without staining the recording medium itself, and even when it is the recording medium of mid-flow of use, the information can be read and used.

Further, for the information 11 relating to the ink absorption characteristic of the recording medium, the magnetic pattern may also be used other than the optical pattern such as a bar-code. Hereupon, for the reading sensor 3 in this case, the magnetic head is used.

Figure 6:
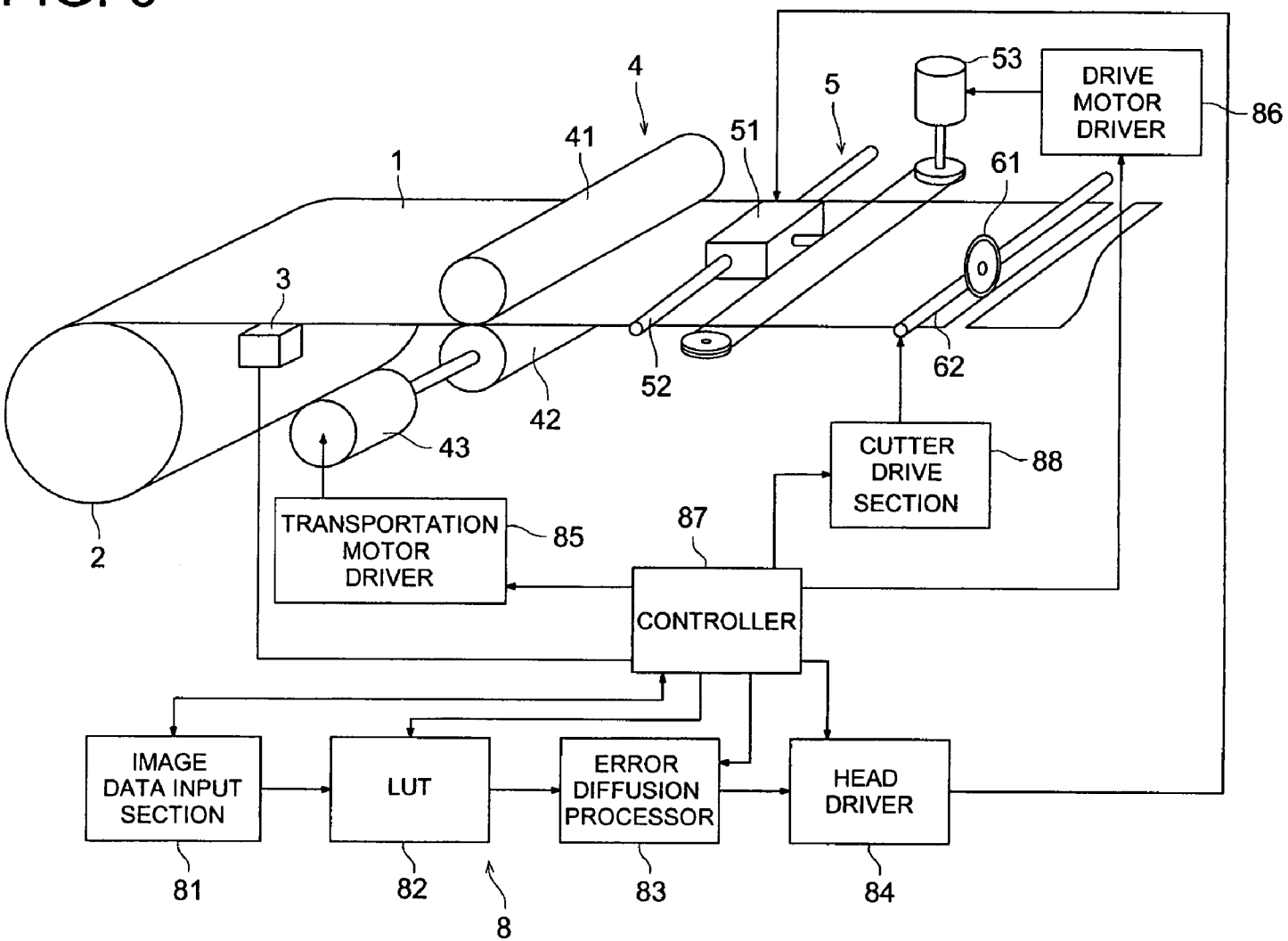
FIG. 6 is an explanation view showing the basic control structure of the inkjet recording apparatus according to the present invention.

The control structure of the inkjet recording apparatus according to the present invention is shown in FIG. 6. As shown in FIG. 6, the inkjet recording apparatus according to the present invention is mainly structured by an image data input section 81 for inputting the image data to be recorded, a LUT (Look Up Table) 82 which controls the number of dots per unit area and an error diffusion processing section 83, a head driver 84 for conducting the control of the recording head 51, a transportation motor driver 85 which controls the transportation motor 43 which is a drive source of the transportation roller 42, a drive motor driver 86 which controls the drive motor 53 for scanning the recording head 51, a cutter drive section 88 for conducting the drive of the cutter 61, and a control section 87 which conducts the control of these components on the basis of the data detected by the reading sensor 3.

The information relating to the ink absorption characteristic of the recording medium detected by the reading sensor 3 (ink absorption amount, ink absorption speed, ink drying time, ink dot diameter) 11 is sent to the control section 87, and in the control section 87, the control for conducting the recording corresponding to respective characteristics is conducted.

Specifically, corresponding to the ink absorption amount, the control of the ink jetting amount per unit area jetted onto the recording medium, is conducted. Further, corresponding to the ink absorption speed, the control of ink jetting amount per unit time jetted onto the recording medium is conducted. Then, corresponding to the ink drying time, the control of the recording interval time at the time of continuous recording is conducted.

Further, corresponding to the ink dot diameter, the control of the ink jetting amount per unit area jetted onto the recording medium (a volume of the jetted ink droplet and the set resolving power) is conducted.

Initially, on the basis of the data relating to the ink absorption amount of the recording medium, a process by which the ink jetting amount per unit area onto the recording medium is controlled, will be described below.

The ink jetting amount per unit area onto the recording medium can be controlled by two control methods which will be described below.

Method 1: a method to control it by changing the number of dots per unit area onto the recording medium.

Method 2: a method to control it by changing the volume of the ink drop jetted onto the recording medium.

The method to control it by changing the number of dots per unit area onto the recording medium is conducted when the control section 87 changes the parameter of the number of dots in the LUT 82, and the error diffusion processor 83.

For example, in the case where the recording is conducted by the mono-chromatic ink under the condition of the ink droplet 10 pl, and the recording resolving power 1200 dpi×1200 dpi, when all dot recording is conducted, the ink of $10/(25.4/1200)^2=22.3$ ml/m$^2$ is jetted.

Figure 7:
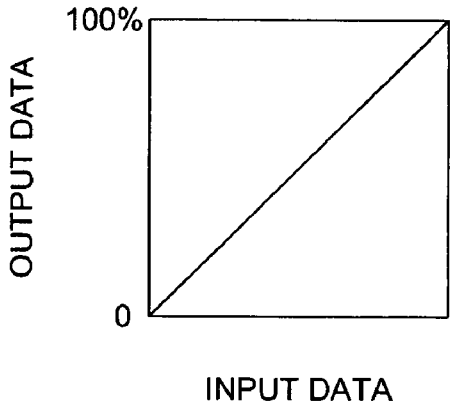
FIG. 7(*a*) and FIG. 7(*b*) are relation views showing the relationship of the ink absorption amount and ink jetting amount used in the LUT when the number of dots per unit area is changed.
Figure 7:
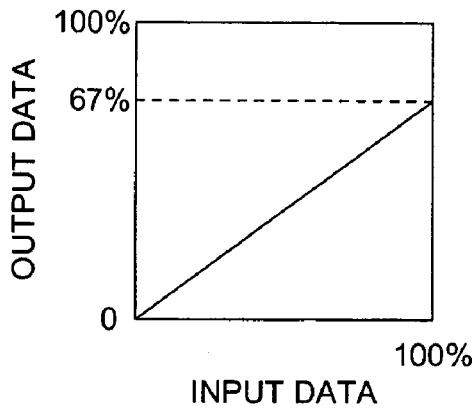

Accordingly, when the maximum ink absorption amount of the recording medium to be recorded is not smaller than 22.3 ml/m$^2$, as the data of a LUT 82, the relational view shown in FIG. 7(*a*) is used, and when the ink absorption amount of the recording medium is not larger than 22.3 ml/m$^2$, for example, 15 ml/m$^2$, because 15/22.3=67%, the correction view shown in FIG. 7(*b*) is used. Because, according to the output value of this LUT 82, the error diffusion processing is conducted, and the dot is formed, when the absorption amount of the recording medium is not larger than a regulated value, corresponding to the rate to the regulated value, the parameter of the number of dots per unit area is changed.

Accordingly, in the above-described case, the parameter of the number of dots per unit area is changed so that the recording is conducted by the number of dots of all number of dots×0.67, and on the basis of this data, when the head driver 84 controls the recording head 51, the ink jetting amount per unit area is controlled.

The method to control by changing the volume of the ink droplet jetted onto the recording medium, written in the method 2, is conducted when the control section 87 changes the drive waveform supplied to the recording head 51 in the head driver 84. Generally, it is known that, when the drive waveform such as the drive voltage or drive time is changed, the dimension of the ink drop when jetted, is also changed, and by using this characteristic, the ink jetting amount per unit area is controlled.

For example, when the maximum ink absorption amount of the recording medium is 22.3 ml/m$^2$, and the recording is conducted onto the recording medium by the mono-color ink under the condition of the recording resolving power of 1200 dpi×1200 dpi, the ink droplet is $22.3\times(25.4/1200)^2=10$ pl, and the drive voltage supplied to the recording head 51 is controlled so as to be such an ink droplet. In the same manner, for example, when the ink absorption amount of the recording medium is 15 ml/m$^2$, the ink droplet is $15\times(25.4/1200)^2=6.7$ pl, and the drive waveform supplied to the recording head 51 is controlled so as to be such an ink droplet.

As described above, on the basis of the data relating to the ink absorption amount of the recording medium, when the ink jetting amount per unit area is controlled, it can be prevented that the ink is over flown and the recording medium or the recording apparatus is stained, or the ink on the recording medium is flocculated and the image graininess is deteriorated.

Next, on the basis of the data relating to the ink absorption speed of the recording medium, a process by which the ink jetting amount per unit time onto the recording medium is controlled, will be described.

The ink jetting amount per unit time onto the recording medium can be controlled by 5 control methods which will be described below.

Method 1: a method by which it is controlled when the scanning speed of the recording head 51 and the ink jetting period are changed.

Method 2: a method by which it is controlled when the waiting time at both end portions of the recording head 51 is changed.

Method 3: a method by which it is controlled by the selection whether the recording by the recording head 51 is conducted only in the outward route or homeward route, or in both routes of outward and homeward routes.

Method 4: a method by which it is controlled when the number of nozzles which are used at the time of 1 scan of the recording head 51 is changed.

Method 5: a method by which it is controlled by changing the number of nozzles which are used at the time of 1 scan when a plurality of recording heads 51 are used.

The method to control it when the scanning speed of the recording head 51 and its ink jetting period are changed, written in the method 1, is conducted when the control section 87 controls the drive motor driver 86 and the head driver 84. The drive motor driver 86 controls the number of rotations of the drive motor 53 for driving the recording head 51, and when the control section 87 controls the drive motor 86, the scanning speed of the recording head 51 is controlled. Further, when the control section 87 controls the head driver 84 so that the ink is jetted in timed relationship with the scanning of the recording head 51, the ink jetting amount per unit time is controlled.

The method to control it when the waiting time at both end portions of the recording head 51 is changed, written in the method 2, is conducted when the control section 87 controls the drive motor driver 86 for controlling the drive motor 53 which is a drive source of the recording head 51. Generally, in the inkjet recording apparatus having the reciprocal scanning type recording head, every time when 1 scanning is completed, the waiting time of the recording head 51 is set at the end portion of its scan route, and when this waiting time is controlled, the ink jetting amount per unit time onto the recording medium 1 is controlled.

The method to control it by the selection whether the recording by the recording head 51 is conducted only in the outward route or homeward route, or in both routes of outward and homeward routes, written in the method 3, is conducted when the control section 87 controls the head driver 84.

For example, when the ink absorption speed of the recording medium is fast, the recording is conducted in both routes of outward route and homeward route, and when the ink absorption speed of the recording medium is slow, the recording is conducted only in any one of the outward route or homeward route at the time of scanning, and when the head driver 84 is set and controlled in such a manner, the ink jetting amount per unit time onto the recording medium is controlled.

The method to control it when the number of nozzles which are used at the time of 1 scan of the recording head 51 is changed, written in the method 4, is conducted when the control section 87 controls the head driver 84.

Figure 8:
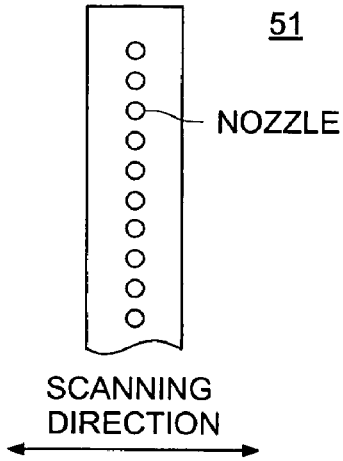
FIG. 8 is a partially enlarged view showing a nozzle portion of a recording head.

As shown in FIG. 8, because the recording head 51 has a plurality of nozzles, for example, when the ink absorption speed of the recording medium is fast, all nozzles are used and the recording is conducted, and when the ink absorption speed of the recording medium is slow, the nozzle is properly used in such a manner that every other nozzle, or every third nozzle is used and the recording is conducted, and when the head driver 84 is set and controlled in such a manner, the ink jetting amount per unit time onto the recording medium is controlled.

The method to control it by changing the number of nozzles which are used at the time of 1 scan when a plurality of recording heads 51 are used, written in the method 5, is conducted when the control section 87 controls the head driver 84.

Figure 9:
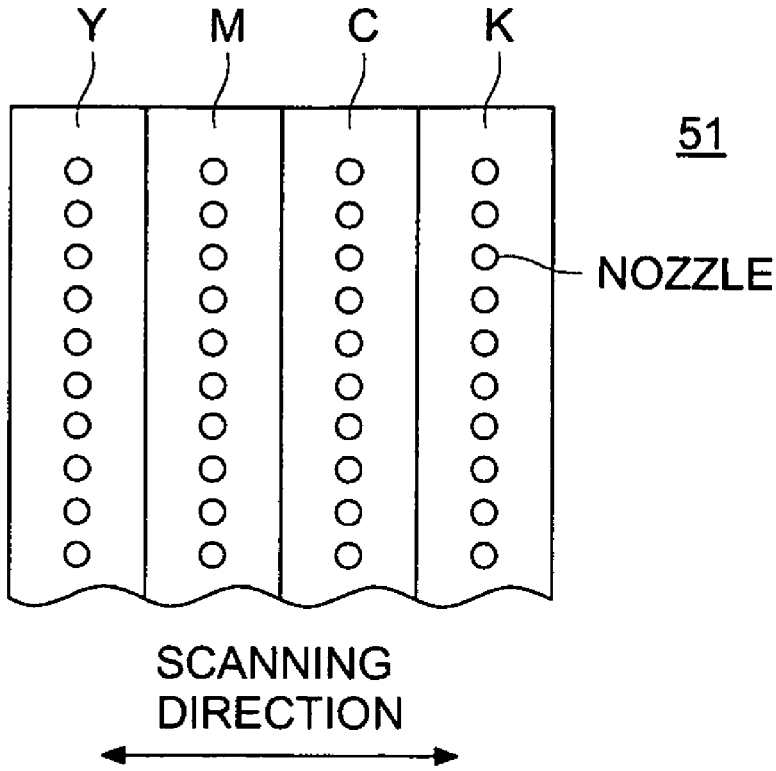
FIG. 9 is a partially enlarged view showing a nozzle portion of the recording head having a plurality of heads.

As shown in FIG. 9, when a plurality of recording heads 51 (in the present example, 1 recording head is used for every 1 color of Y: yellow, M: magenta, C: cyan, K: black) are used, for example, the recording heads are properly used in such a manner that, when the ink absorption speed of the recording medium is fast, all heads of Y, M, C, K are simultaneously used and the recording is conducted, when the ink absorption speed of the recording medium is medium, in the outward route, the recording of only Y, C is conducted, and in the homeward route, the recording of only M, K is conducted, and when the ink absorption speed of the recording medium is slow, the recording of only Y is conducted in the outward route of the first scanning, and the recording of only M is conducted in its homeward route, and in the outward route at the second scanning, the recording of only C is conducted, and in its homeward route, the recording of only K is conducted, and when the head driver 84 is set and controlled in such a manner, the ink jetting amount per unit time onto the recording medium is controlled.

As described above, according to the data relating to the ink absorption speed of the recording medium, when the ink jetting amount per unit time is controlled, it can be prevented that the ink on the recording medium is flocculated and the image graininess is deteriorated.

Next, on the basis of the data relating to the ink drying time of the recording medium, a process by which the recording interval time at the time of the continuous recording is controlled, will be described.

As shown in FIG. 1, in the recording section 5, the recording medium 1 recorded by the recording head 51 waits at the position while the ink of the recording medium 1' which is recorded just before and stocked on the sheet ejection tray 7, is dried, and after the passage of the ink drying time, it is cut in the cutting section 6, and stacked on the recording medium 1' which is stocked on the sheet ejection tray 7.

The control of the recording interval time is conducted when the control section 87 observes the passing time after the recording of the recording medium 1' which is recorded just before, and controls so that the cutting of the next recording medium is not conducted until the drying time of the recording medium 1 passes.

As described above, on the basis of the data relating to the ink drying time of the recording medium 1, when the time interval at the time of continuous recording is controlled, in the sheet ejection tray, the transfer of the ink caused when the next recording medium is stacked before the ink of the recording medium after the recording is dried, or the disturbance of the image due to the rubbing can be prevented.

Next, according to the data relating to the ink dot diameter of the recording medium, a process by which the ink jetting amount (ink droplet volume or recording resolving power) is controlled, will be described. The ink dot diameter referred-herein means a diameter of the unit dot of the ink recorded on the recording medium (note: even when the droplet volume of the ink unit dot is the same, the diameter of the dot formed on the recording medium is different according to the characteristic of the recording medium.).

A control method by which the volume of the ink droplet jetted onto the recording medium which is a factor to determine the ink jetting amount per unit area is changed, is, as described above, conducted when the control section 87 changes the drive waveform supplied to the recording head 51 in the head driver 84. Generally, it is well-known that, when the drive waveform changes, the dimension of the ink drop when jetted, also changes, and when this characteristic is used, the volume of the ink droplet is controlled.

That is, according to the data relating to the ink dot diameter of the recording medium, the drive waveform supplied to the recording head 51 is controlled in such a manner that the volume of the ink droplet is controlled so that the ink is spread to the specified dot diameter when the ink is jetted onto the recording surface of the recording medium.

Further, the control of the recording resolving power which is a factor to determine the ink jetting amount per unit area is conducted when the resolving power in the transportation direction (primary scanning direction) of the recording head 51 and the resolving power in the transportation direction (secondary scanning direction) of the recording medium 1 are controlled.

The control of the resolving power relating to the primary scanning direction is conducted when the control section 87 controls the drive motor driver 86 and head driver 84 in such a manner that the number of dots of the ink per unit length of the recording head 51 which is jetted in timed relationship with the scanning is controlled. The control of the resolving power relating to the secondary scanning direction is conducted when the control section 87 controls the transportation motor driver 85 in such a manner that the conveyed amount of the recording medium 1 for every scanning of the recording head 51 is controlled.

As described above, on the basis of the data relating to the diameter of the ink dot of the recording medium, when the ink jetting amount per unit area (ink droplet volume or recording resolving power) is controlled, corresponding to the spread of the ink dot on the recording medium, recording can be conducted with the optimum ink droplet volume or recording resolving power, and with the necessary and sufficient ink amount, the necessary and sufficient density can be secured.

Figure 10:
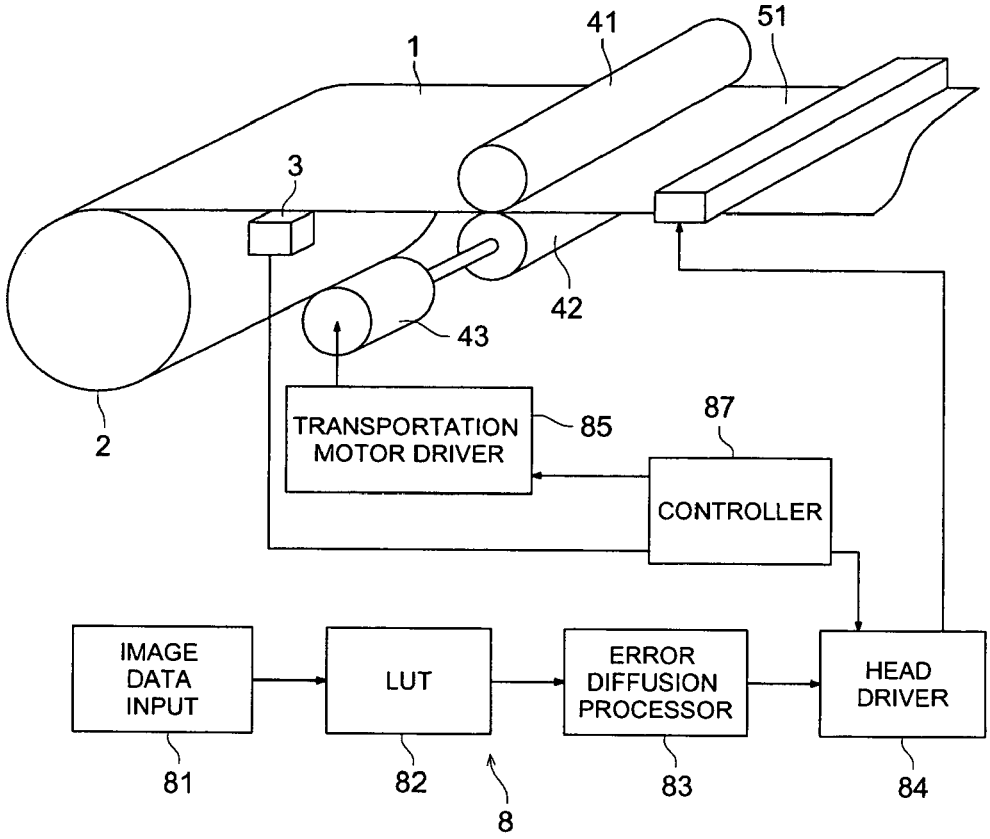
FIG. 10 is an explanation view showing the control structure of the inkjet recording apparatus having a line head as the recording head which is another example of the inkjet recording apparatus according to the present invention.

Hereupon, the inkjet recording apparatus according to the present invention described above, although the recording head having the reciprocal scanning type head is taken as an example and described as the recording head, as shown in FIG. 10, as the recording head, the inkjet recording apparatus in which a line head having the length corresponding to the width of the recording medium is adopted, can also be used.

For example, according to the data relating to the ink absorption speed of the recording medium, when the case where the ink jetting amount per unit time onto the recording medium is controlled, is taken as an example and described, it is as follows.

The ink jetting amount per unit time onto the recording medium can be controlled when the recording medium transportation speed or the ink jetting period is changed.

The recording medium transportation speed is determined by the number of rotation of the transportation motor 43 which is a drive source of the transportation roller 42. Because the number of rotation of this transportation motor 43 is controlled by the transportation motor driver 85, it can be controlled when the control section 87 controls the transportation motor driver. Further, the ink jetting period can be controlled, as described above, when the control section 87 controls the head driver 84. Accordingly, by such a means, the control of the ink jetting amount per unit time onto the recording medium can be conducted.

As described above, the present invention can be applied also for the inkjet recording apparatus having the line head as the recording head.

As described above, according to the embodiment 1 of the present invention, because the inkjet recording medium previously records the information showing the ink absorption amount, ink absorption speed, ink drying time, ink dot diameter, which are its ink absorption characteristic, it is not necessary that the setting operation for every recording medium exchange is conducted. Accordingly, eccept that the trouble of the setting operation can be omitted, a problem of mis-setting accompanying that, can be prevented. Further, even when it is the recording medium of the mid-flow of use, it can be used without any trouble.

Further, as described above, the inkjet recording medium and inkjet recording apparatus according to the present invention can conduct the optimum recording respectively corresponding to the characteristic onto a plurality of kinds of recording media, because, previously, the information showing the ink absorption characteristic is recorded in the recording medium, and in the inkjet recording apparatus which conducts the recording onto the recording medium, the information relating to the ink absorption characteristic of the recording medium is read, and the recording is conducted corresponding to its characteristic. Accordingly, also onto the various kinds of recording media in the recent years, it can correspond, and can efficiently produce the high quality image print.

EMBODIMENT 2 OF THE INVENTION

Figure 11:
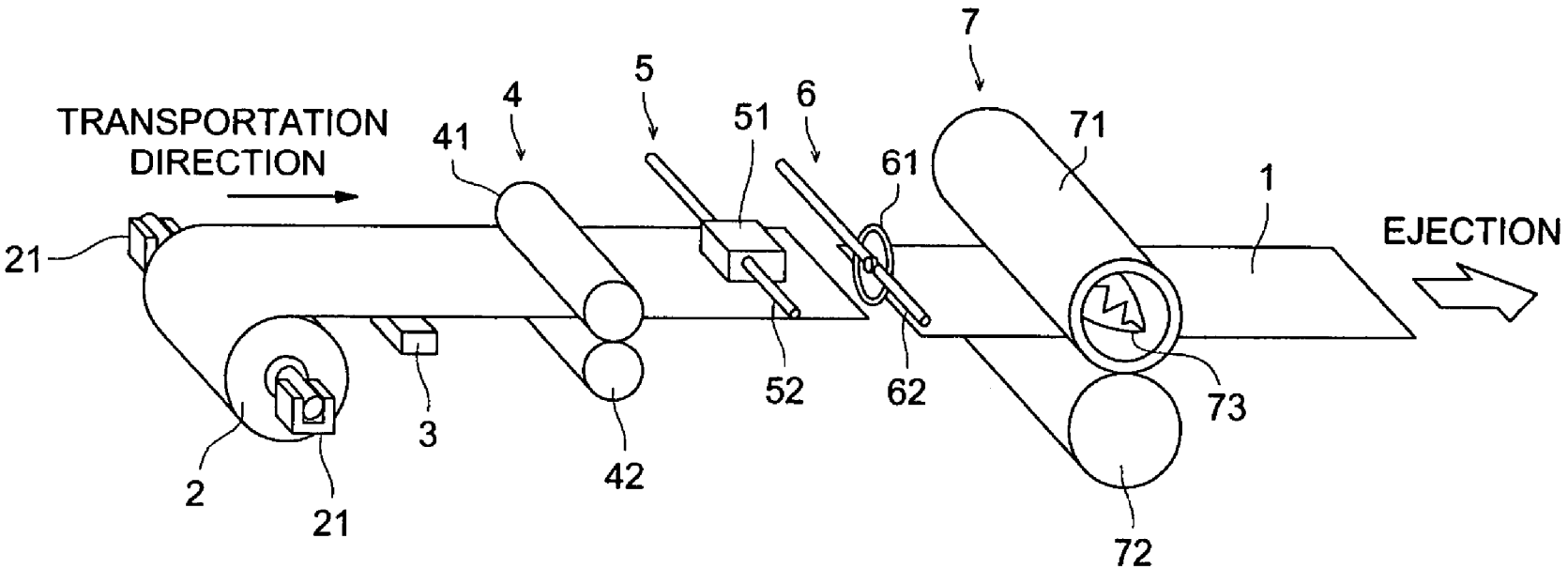
FIG. 11 is an overall view expressing the basic structure of the inkjet recording apparatus of the present invention.

As shown in FIG. 11, the inkjet recording apparatus according to Embodiment 2 of the present invention is, mainly, structured by a recording medium supporting section 21 for supporting the master roll 2 of the recording medium 1, read sensor 3 provided in its vicinity, recording medium transportation means 4 which is a means for transportation the recording medium 1 and composed of the drive roller 41 and driven roller 42, recording section 5 composed of the recording head 51 and guide 52, cutting section 6 composed of a cutter 61 and a guide 62, and heating and pressing section 7 composed of a heating roller 71 having the heating body 73 and a pressure roller 72. The recording head 51 may also be structured so that an ink tank is housed, and further, it may also be structured so that, for example, the ink is supplied from the external ink tank.

The recording medium 1 is pulled out from the master roll 2 by the recording medium transportation means 4, and after the information 11 showing the heating and/pressing condition is read by the reading sensor 3, it is recorded by the recording head 51 in the recording section 5. This recording head 51 is structured in such a manner that it can reciprocate on the recording medium 1 along the guide 52. The recording medium 1 after the recording is cut into a predetermined size by the cutter 61 in the cutting section 6 provided in the downstream of its transportation direction. The cutter 61 is structured in such a manner that it can reciprocate on the recording medium 1 along the guide 62. The recording medium 1 cut into a desired size in the cutting section 6 is further conveyed to the heating and pressing section 7, and in the heating and pressing section 7, the heating and pressing processing is conducted by the heating roller 71 and pressing roller 72. The recording medium 1 on which the heating and pressing processing is conducted is delivered to the tray whose graphic display is omitted, and which is provided in the external portion of the inkjet recording apparatus.

Figure 12:
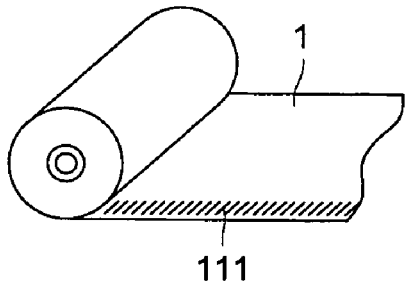
FIG. 12 is a view showing a recording medium 1 used for the inkjet recording apparatus shown in FIG. 11.
Figure 14:
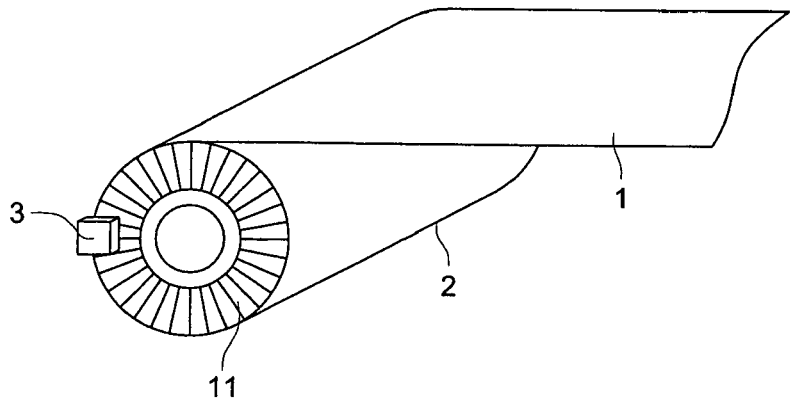

As shown in FIG. 12, it is structured in such a manner that the information 111 showing the heating and/pressing condition at the time of fixing is recorded in the vicinity of end portion of the recording medium by using, for example, a bar-code, and when the recording medium 1 pulled out from the master roll by the recording medium transportation means 4 passes near the reading sensor 3 using, for example, a reflection photo-sensor which is provided in the vicinity of that, the information is read. The information 111 showing this heating and/pressing condition may also be recorded in the side surface portion of the master roll 2 as shown in FIG. 14. Hereupon, as shown in the same view, the reading sensor 3 is provided in its vicinity.

Further, for the information 111 showing the heating and/pressing condition, instead of the optical pattern such as the bar-code, the magnetic pattern may also be used. Hereupon, for the reading sensor 3 in this case, the magnetic head is used.

Figure 13:
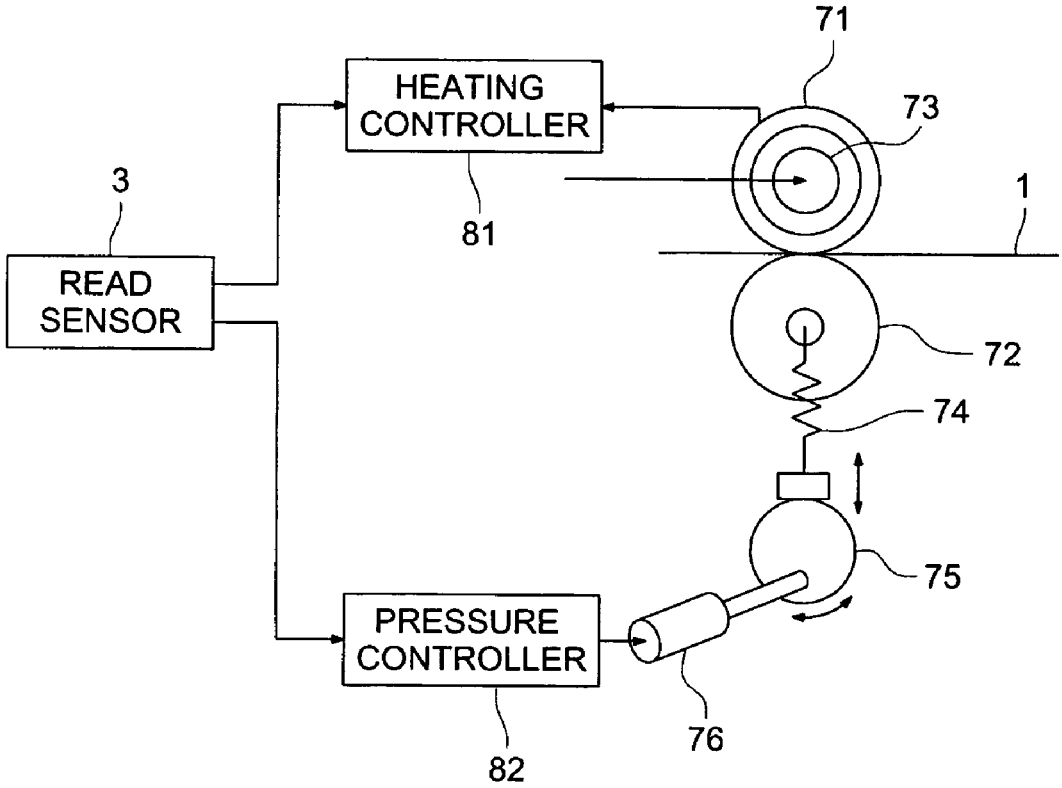
FIG. 13 is a control explanation view expressing the control structure of the inkjet recording apparatus according to the present invention.

As shown in FIG. 13, the information 111 showing the heating and/pressing condition which is read by the reading sensor 3 is transmitted to the heating control section 81 and pressing control section 82.

The heating control section 81 which receives the information 111, controls the heating amount of the heating body 73 provided in the heating roller 71, and adjusts the heating temperature to the recording medium 1. For example, the heating body 73 is an electric heater, and in the heating control section 81, when the current value supplied to the heating body 73 or current-carrying time is controlled, the heating temperature is adjusted.

The temperature of the heating roller 71 is detected by the sensor whose graphic display is omitted, and its value is fed back to the heating control section 81. In the heating control section 81 which receives this, on the basis of this value, the heating temperature to the recording medium 1 is adjusted again.

The pressing control section 82 which receives the information 111, controls the pressing pressure of the pressing means 74 connected to the pressing roller, and adjusts the pressing pressure to the recording medium 1. As shown in FIG. 12, for example, the pressing means 74 is a spring, and by the rotation control of the motor 76, the rotation position of the eccentric cam 75 arranged at its lower end is controlled, and the pressing pressure to the recording medium 1 is adjusted.

As described above, in the inkjet recording apparatus by which, in the recording medium, the information showing the heating and/or pressing condition corresponding to its characteristic is previously recorded, and the recording is conducted on the recording medium, when the information showing the heating and/or pressing condition is read, and the heating and pressing processing is conducted under the heating and/or pressing condition, the adequate fixing processing can be conducted always, and the high quality image print can be produced. Further, every attachment of the recording medium, because the information showing the heating and/or pressing condition is automatically read, it can correspond to a plurality of kinds of recording media or also to the recording medium on the mid-flow of use. Further, it is not necessary that the heating and/or pressing condition is input every attachment of the recording medium, and the trouble can be omitted. Further, accompanying this, it is also prevented that the heating and/or pressing condition is set under the erroneous condition.

Hereupon, in the inkjet recording apparatus shown in FIG. 11, the case where the recording medium wound roll-like is used is shown as an example, however, also other than this, for example, there is also a case where the recording medium in which the information showing the heating and/or pressing condition is recorded, and which is cut into sheet-like, is used.

Figure 15:
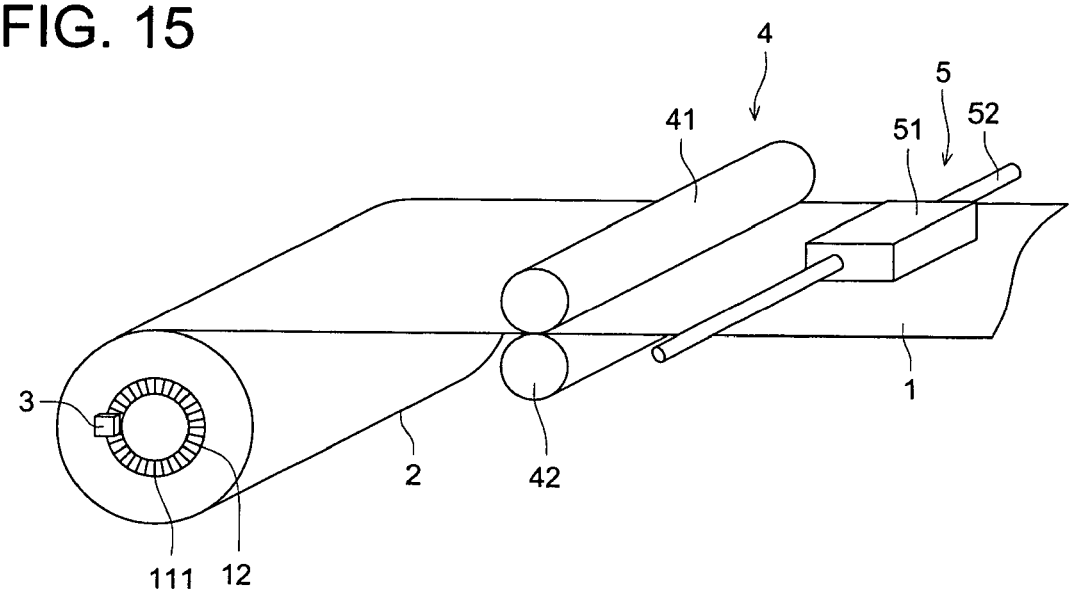

Next, the inkjet recording apparatus according to another example of the present invention and the inkjet recording medium used for it, will be shown in FIG. 15 and described.

As shown in FIG. 15, the recording medium 1 used for the inkjet recording apparatus in the present embodiment, is wound around the core member 12, and in the end portion of the core member 12, the information showing the heating and/or pressing condition is recorded. Further, in the vicinity of it, the reading sensor 3 for reading the information 111 is provided. Hereupon, relating to a part omitted in FIG. 15, the part of the inkjet recording apparatus shown in FIG. 11, is applied correspondingly, and further, also for its control structure, the structure shown in FIG. 13 is applied correspondingly.

As described above, when the information showing the heating and/or pressing condition is recorded in the end portion of the core member around which the recording medium is wound, the recording surface of the recording medium is not made useless, and even when it is the recording medium on the mid-flow of use, the information can be read from it and used.

Hereupon, in the information 111 showing the heating and/or pressing condition, instead of the optical pattern such as a bar-code, the magnetic pattern may be used, and the reading sensor corresponding to this may also be provided. Further, for the information 11 showing the heating and/or pressing condition, the semiconductor memory can also be used.

Figure 16:
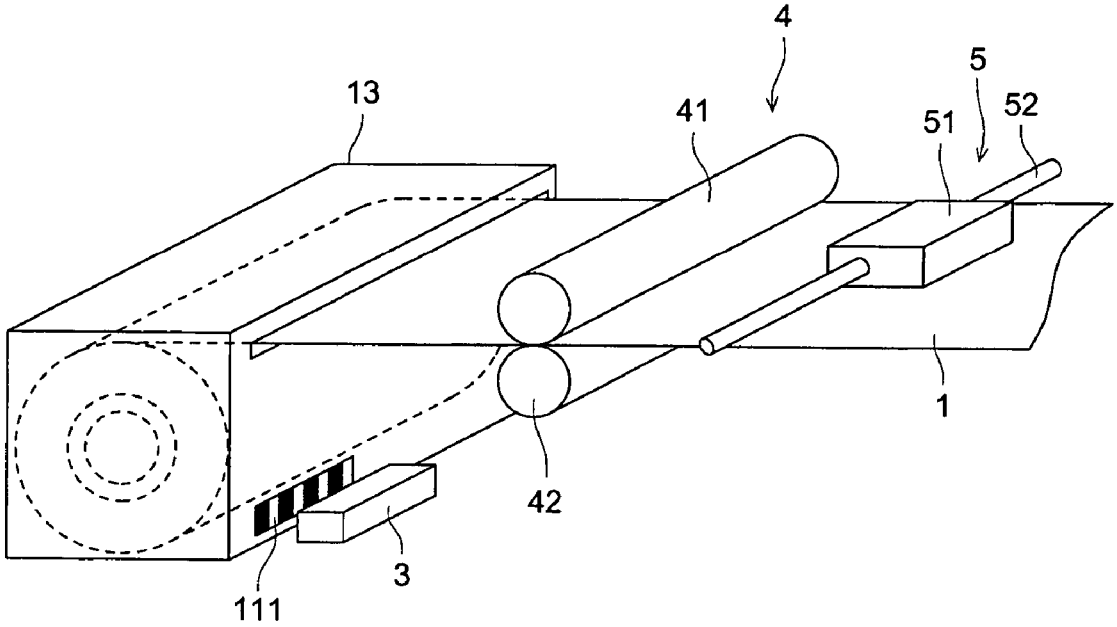

Next, the inkjet recording apparatus according to another example of the present invention, and the inkjet recording medium used for it, will be shown in FIG. 16 and described.

As shown in FIG. 16, the recording medium 1 used for the inkjet recording apparatus in the present embodiment is accommodated in the accommodating member 13, and the information 111 showing the heating and/or pressing condition is previously recorded on the outer wall of the accommodating member 13. Further, in its vicinity, the reading sensor 3 for reading the information 111 is provided. Hereupon, in the same view, for the omitted part, the part of the inkjet recording apparatus shown in FIG. 11 is applied correspondingly, and further, also for the control structure, the structure shown in FIG. 13 is applied correspondingly.

As described above, when the information showing the heating and/or pressing condition is recorded on the outer wall of the accommodating member for accommodating the recording medium, the recording surface of the recording medium is not made useless, and even when it is the recording medium on the mid-flow of use, the information can be read and used.

Hereupon, for the information 111 showing the heating and/or pressing condition, instead of the optical pattern such as a bar-code, the magnetic pattern may be used, and the reading sensor corresponding to it, may also be provided. Further, for the information 111 showing the heating and/or pressing condition, the semiconductor memory can also be used.

Further, as the inkjet recording apparatus shown in FIG. 16, the case where, in the accommodating member 13, the recording member wound roll-like is accommodated, is shown as an example, however, other than this, for example, there is also a case where, in the accommodating member 13, the recording medium which is cut sheet-like is accommodated.

As described above, according to the embodiment 2 of the present invention, in such an inkjet recording medium and inkjet recording apparatus, in the recording medium, the information showing the heating and/or pressing condition corresponding to its characteristic is previously recorded, and in the inkjet recording apparatus which records in the recording medium, the information showing the heating and/or pressing condition is read, and when the heating and pressing processing is conducted under the heating and/or pressing condition, the adequate fixing processing can be conducted always, and the high quality image print can be produced. Further, because, every attachment of the recording medium, the information showing the heating and/or pressing condition is automatically read, it can correspond to a plurality of kinds of the recording media or also to the recording medium on the mid-flow of use. Further, it is not necessary that, every attachment of the recording medium, the heating and/or pressing condition is inputted, and a trouble can be omitted. Further, it can be eliminated that the heating and/or pressing condition is set under the false condition.

EMBODIMENT 3 OF THE INVENTION

Figure 17:
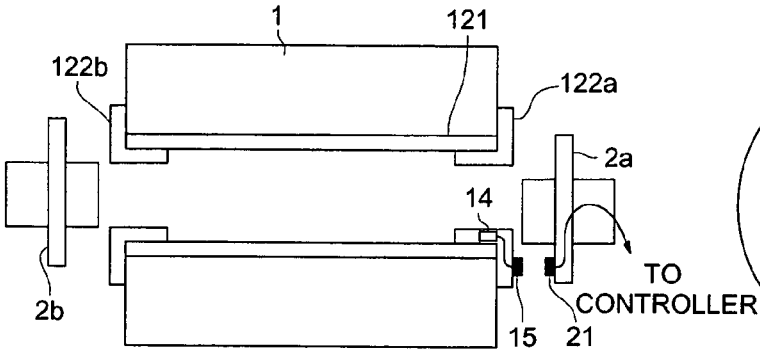
FIG. 17(*a*) and FIG. 17(*b*) are a front sectional view and a side view showing an image recording medium wound around the core member.
Figure 17:
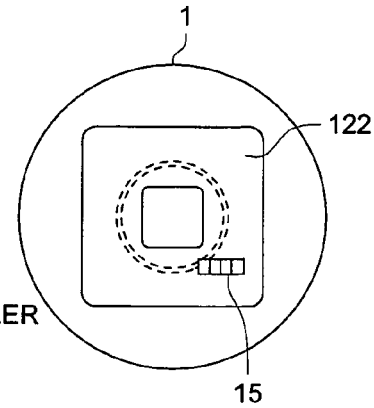

Next, the embodiment 3 of the present invention will be described. FIG. 17(*a*) is an exploded front view, and FIG. 17(*b*) is a side view of a side to which the supporting member is attached. FIG. 17(*a*), (b) show an example in the roll-like recording medium in which the recording medium 1 is wound around the core member. It is separated into a part 121 in which the core member is rotated together with the recording medium 1 and a part 122 (122*a*, 122*b*) in which it is not rotated. The non-volatile memory 14 is attached to the not-rotated part 122 side. As an example of the non-volatile memory, EEPROM or flash memory can be listed. Further, the non-volatile memory access means 15, is also provided to the not-rotated part 122*a*.

The roll-like recording medium is held in the image recording apparatus by using the recording medium holding member 20. In the recording medium holding member 20*a*, the non-volatile memory access means 21 is provided.

The information recorded in the non-volatile memory 14 is read into the control section 30 of the image recording apparatus between the non-volatile memory access means 15 of the not-rotated part 122*a* and the non-volatile memory access means 21 provided in the recording medium holding member 20*a*. Writing into the non-volatile memory 14 is conducted through between the non-volatile memory access means 21 and the non-volatile memory access means 15.

Figure 18:
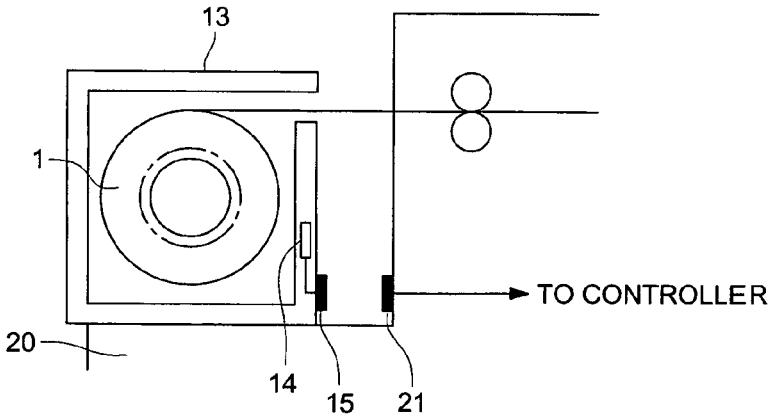
FIG. 18 is a view showing an outline sectional view showing the image recording medium accommodated in the accommodating member.

FIG. 18 shows an example in which the recording medium is accommodated in the recording medium accommodating member 13. The non-volatile memory 14 is mounted on the recording medium accommodating member 13. Further, the non-volatile memory access means 15 is also provided in the recording medium accommodating member 13.

In the image recording apparatus, the image recording medium in which the recording medium 1 is accommodated is held by the recording medium holding section 20. The non-volatile memory access means 21 is provided in the recording medium holding section 20.

The information recorded in the non-volatile memory 14 is read into the control section 30 of the image recording apparatus between the non-volatile memory access means 15 of the recording medium accommodating member 13 and the non-volatile memory access means 21 of the recording medium holding member 20. Writing into the non-volatile memory 14 is conducted through between the non-volatile memory access means 21 and the non-volatile memory access means 15.

Figure 19:
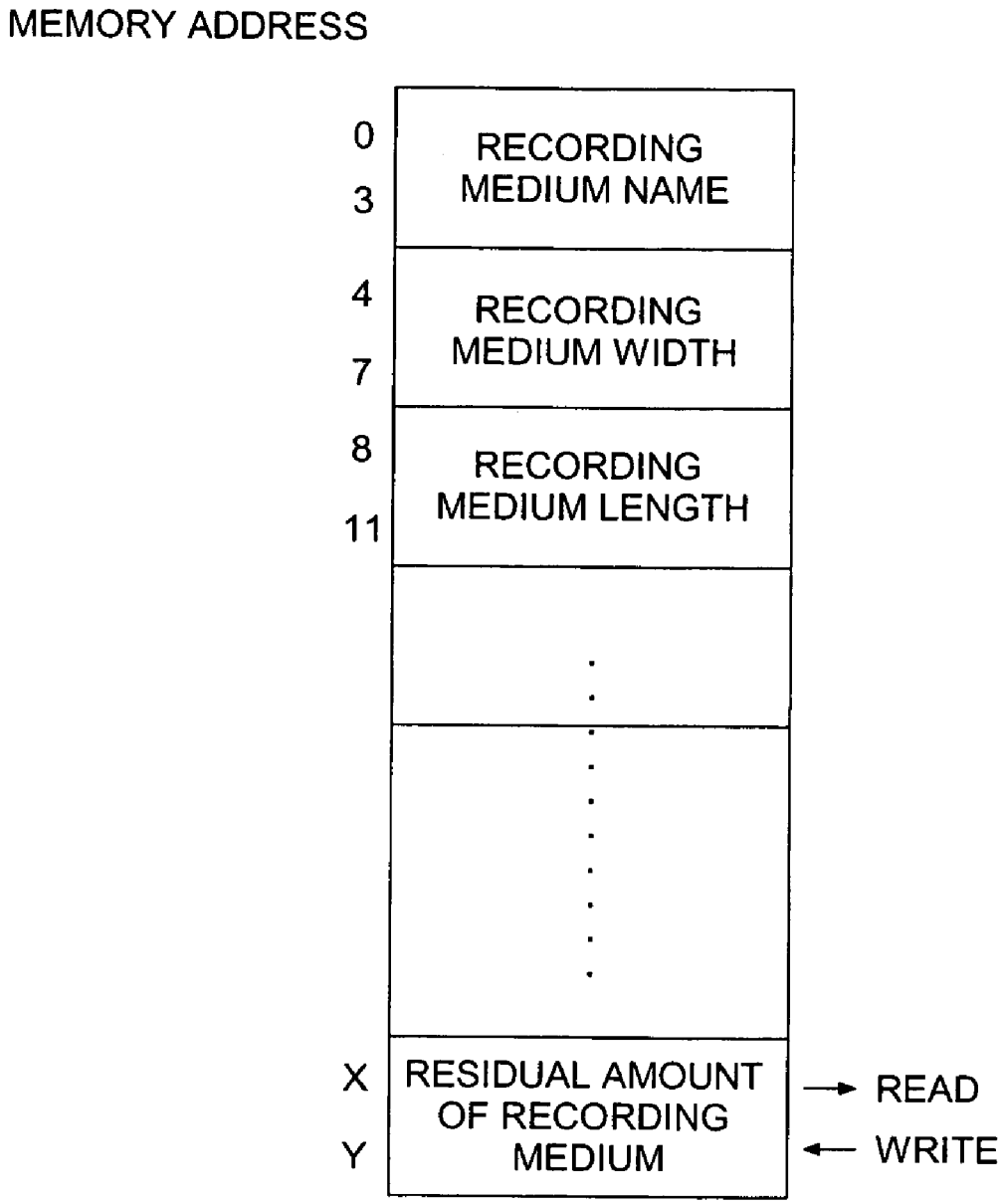
FIG. 19 is a view showing an example of the non-volatile memory address allotment.

FIG. 19 shows an example of the content of the recording medium information recorded in the non-volatile memory 14. In he recording of the recording medium 1 information into the non-volatile memory 14, a lot number of the memory address in which each information relating to the recording medium 1 is recorded is set in such a manner that the name of the recording medium is recorded in the address from the memory address 0 to 3, the width of the recording medium is recorded in the address from the memory address 4 to 7, and the length of the recording medium is recorded in the address from the memory address 8 to 11.

A lot number of the memory address to write in and renew the information which is changed when the recording medium 1 is used, is set in such a manner that the writing and renewing are conducted on the address from the memory address X to Y. When there are several kinds of recording renewal items, also in the allotment of a lot number of memory address, a lot number of the memory address is set in such a manner that each information can be written in and renewed.

Further, for the recording of the information relating to the recording medium 1 into the non-volatile memory 14, a lot number of the recording address or occupancy width of a lot number of the address may also be changed at need by an amount of the recording information or the order of the recording information to the memory address in which the information is recorded.

When the non-volatile memory 14 is fitted to the image recording medium, not only offer the information relating to the recording medium 1 to the image recording apparatus, the rewriting renewal of the information relating to the recording medium 1 becomes possible by the image recording apparatus. Further, because the content recorded in the non-volatile memory 14 is the information relating to the recording medium 1 of the image recording medium to which the non-volatile memory is fitted, also in the situation that it is used while the various kinds of image recording media are exchanged, the information relating to the recording medium 1 including the rewritten information can be offered to the image recording apparatus.

Figure 20:
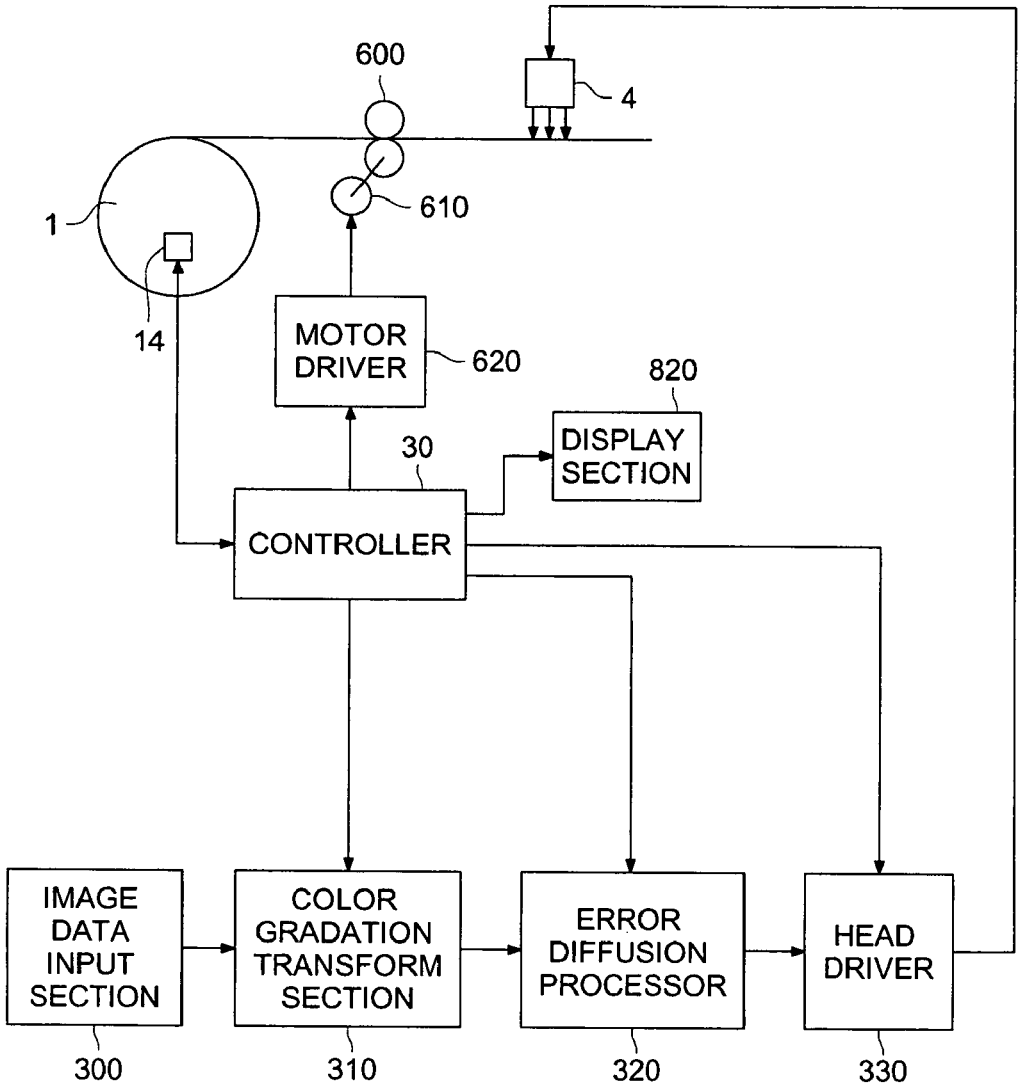
FIG. 20 is an outline structural view of an image recording apparatus.

FIG. 20 shows the outline structural view of the image recording apparatus as another embodiment of the present invention.

The above-described roll-like recording medium is held in the image recording apparatus through the recording medium holding member 20. The recording medium 1 is conveyed by a transportation roller 600, and the image is recorded by the recording head 5. The recording image is color-corrected in a gradation transform section 310 from an image input section 300, and processed in an error diffusion processor 320 and sent to the recording head 5 through a head driver 330, and the recording image is recorded in the recording medium 1 by the recording head 5.

The image recording apparatus reads the information relating to the recording medium 1 recorded in the non-volatile memory 14 in the control section 30. On the basis of this information, the control section 30 controls the color gradation transform section 310, error diffusion processor 320, and head driver 330, and the transportation amount of the recording medium 1 is controlled by the motor driver 620.

In the image recording apparatus, a display section 820 which displays the information read from the non-volatile memory 14 is provided. Thereby, the recording medium 1 to record the image held in the image recording apparatus can be easily known.

The control section 30 is characterized in that: it discriminates the held recording medium 1 whether it adapts to the image recording apparatus, from the information read from the non-volatile memory 14, and controls so that the image is not recorded, when the recording medium 1 does not adapt to the image recording apparatus. When the recording medium 1 is discriminated whether it adapts or not, the uselessness of the recording medium 1 by the quality deterioration of the recorded image caused when a fault recording medium 1 is held in the image recording apparatus, can be prevented. Further, when it is displayed on the display section 820 that the recording medium 1 does not adapt to it, it can be easily known that the held image recording medium does not adapt to the image recording apparatus.

Further, the control section 30 has a function that the recording medium 1 can calculate the residual amount or used amount of the image recording medium such as the roll-like recording medium wound around the core member, and the writing in the non-volatile memory 14 of the residual amount or used amount of the recording medium 1 changed when the image recording medium is used, is conducted by using an image recording medium non-volatile memory access means 15 and an image recording apparatus non-volatile memory access means 21.

For example, as the result when the recording medium 1 is used, the recording apparatus writes the used amount of the recording medium 1 in the addresses from a lot number of the memory address X to Y of the non-volatile memory shown in FIG. 19 and renews it. Further, the allotment of the memory address in which the information is written and which is renewed, is conducted in such a manner that, in the case of the residual amount of the recording medium 1, the image recording apparatus writes it in the determined memory address and renews it.

Further, in the image recording apparatus, the information relating to the residual amount or used amount of the recording medium 1 which is the information relating to the recording medium 1 of the non-volatile memory 14 is read, and after the image recording medium is used, the residual amount or used amount of the recording medium 1 is written in and renewed.

When the information relating to the residual amount or used amount of the image recording medium read from the non-volatile memory 14 of the image recording medium held in the image recording apparatus is displayed on the display section 820 of the image recording apparatus, the residual amount of the image recording medium can be easily known.

Because the information relating to the residual amount or used amount of the recording medium 1 is recorded in the non-volatile memory 14 provided in the image recording medium, even when the image recording medium is removed on the mid-flow of use from the image recording apparatus, when it is reused, it can be correctly detected when the residual amount or used amount of the recording medium 1 of the image recording medium is read from the non-volatile memory 14. Further, when these pieces of the information are displayed on the display section 820, the residual amount of the image recording medium can be easily known.

Figure 21:
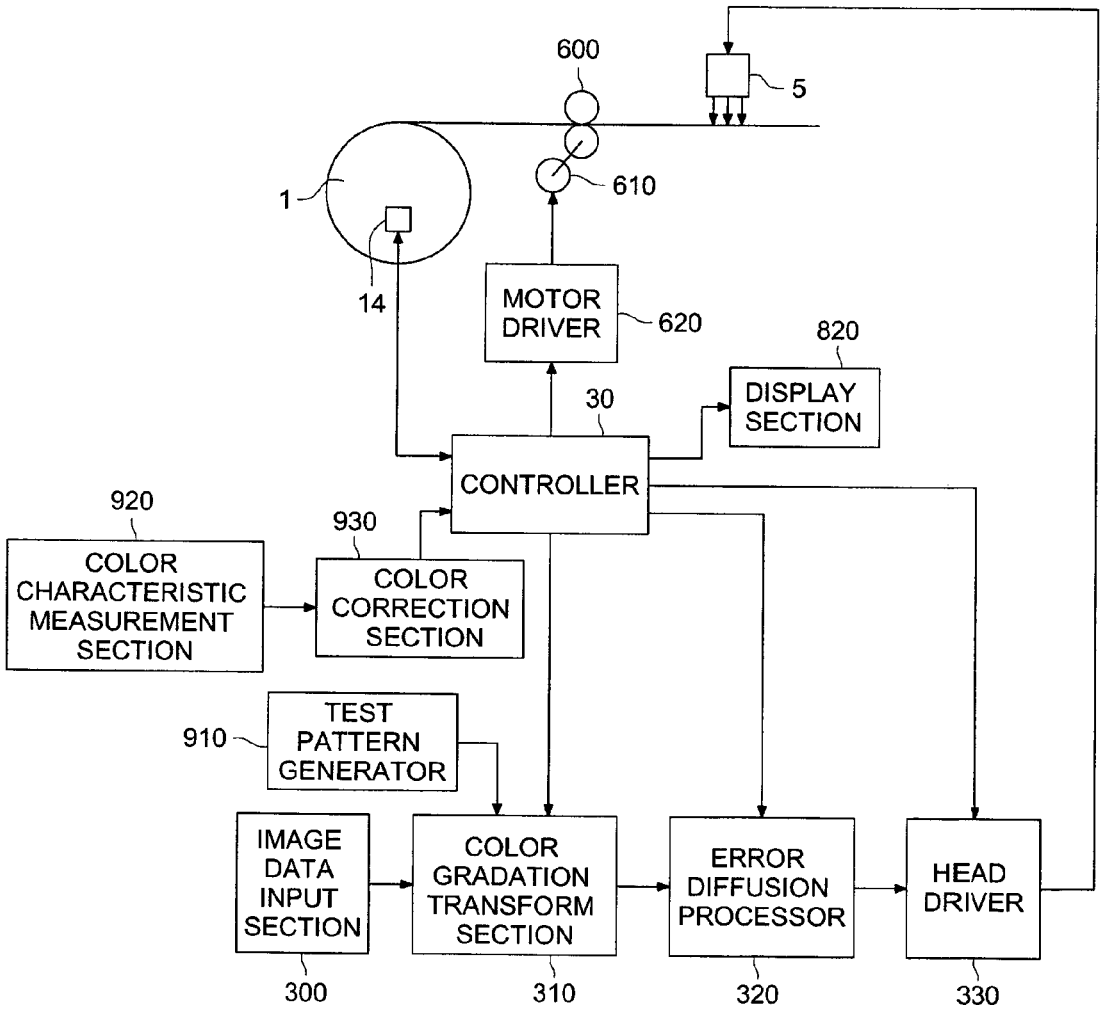
FIG. 21 is an outline structural view of the image recording apparatus having the color correction function.

FIG. 21 shows an outline structure of the image recording apparatus by which the color correction of the image recording medium is conducted as another embodiment.

The roll-like recording medium described above is held in the image recording apparatus through the recording medium holding member 20. The recording medium 1 is conveyed by the transportation roller 600, and the image is recorded by the recording head 5. The recorded image is color corrected in the color gradation transform section 310 from the image input section 300, processed in the error diffusion processor 320, through the head driver 330, sent to the recording head 5, and recorded in the recording medium 1 by the recording head 5 as the recording image.

The image recording apparatus reads the information relating to the recording medium 1 which is recorded in the non-volatile memory 14, in the control section 30. On the basis of this information, the control section 30 controls the color gradation transform section 310, error diffusion processor 320, and head driver 330 so that the recording image becomes high quality in the using recording medium 1, and the transportation amount of the recording medium 1 is conducted when the motor driver 620 is controlled.

In order to conduct the color correction of the image recording medium, a test pattern by a test pattern generator 910 is recorded in the recording medium 1 by the recording head 5 through the color gradation transform section 310, error diffusion transform section 320, and head driver 330. The gradation of the color of the test pattern recorded in the recording medium 1 is measured in a color characteristic measurement section 920. On the basis of the measured color gradation, an ideal color gradation correction curve which is a means of the color correction, is calculated in the color correction means 930. In the control section 30, the color gradation correction curve information is outputted to the color gradation transform section 310 so that the recording image in the recording medium 1 becomes the optimum color gradation. In the color gradation transform section 310, the color gradation of the recording image is changed, to the image to be recorded, corresponding to this color gradation correction curve.

In the image recording apparatus, the color correction information calculated by the color correction means 930 is written into the non-volatile memory 14 of the image recording medium from the control means 30 by using the recording medium non-volatile memory access means 15 and the image recording apparatus non-volatile memory access means 21, and renewed.

When the image recording apparatus reads the color correction information by using the recording medium non-volatile memory access means 15 and the image recording apparatus non-volatile memory access means 21 from the non-volatile memory 14 of the image recording medium, the color correction of the recording image can be accurately conducted.

As described above, when the color correction information of the image recording medium is recorded in the non-volatile memory 14, while various kinds of image recording media are exchanged corresponding to the purpose, even when it is held and used in the image recording apparatus, every when the image recording medium is exchanged, because the color correction information is read from the non-volatile memory 14 of the image recording medium, it is not necessary that the color correction is conducted. Therefore, the uselessness of the recording medium 1 to conduct the color correction or the time of the color correction is saved.

According to the image recording medium written in the above-described embodiment 3, the information relating to the recording medium can be accurately offered, and the information changed when the recording medium is used can be rewritten and renewed.

Further, according to the image recording medium written in the embodiment 3, the information relating to the recording medium can be accurately offered, and the information changed when the recording medium is used can be rewritten and renewed.

Further, according to the image recording medium written in the embodiment 3, the information relating to the recording medium can be accurately offered, and the information changed when the recording medium is used can be rewritten and renewed.

Further, according to the image recording medium written in the embodiment 3, the information relating to the recording medium can be accurately offered, and further, the residual amount or used amount of the recording medium changed when the recording medium is used can be accurately offered, and the residual amount or used amount of the recording medium changed when the recording medium is used can be rewritten and renewed.

Further, according to the image recording medium written in the embodiment 3, the information relating to the recording medium can be accurately offered, and further, the color correction information of the recording medium can be accurately offered, and the information changed when the recording medium is used can be rewritten and renewed.

Further, according to the image recording apparatus written in the embodiment 3, the information relating to the recording medium of the non-volatile memory can be accurately read in, and the information changed when the recording medium is used can be written in and renewed.

Further, according to the image recording apparatus written in the embodiment 3, the information relating to the recording medium from the non-volatile memory can be accurately read in, and the information changed when the recording medium is used can be written in and renewed.

Further, according to the image recording apparatus written in the embodiment 3, the information relating to the recording medium can be accurately read in from the non-volatile memory, and the information changed when the recording medium is used can be written in and renewed.

Further, according to the image recording apparatus written in the embodiment 3, the information relating to the recording medium can be accurately read in from the non-volatile memory, the information changed when the recording medium is used can be written in and renewed, and the information relating to the recording medium can be easily confirmed.

Further, according to the image recording apparatus written in the embodiment 3, it is judged whether the characteristic of the recording medium of the image recording medium held in the image recording apparatus adapts to the image recording apparatus, and when it does not adapt to it, by being able to conduct in such a manner that the recording of the image is not conducted, the deterioration of the quality of the recording image can be prevented when the image is recorded in the recording medium.

Further, according to the image recording apparatus written in the embodiment 3, the information relating to the recording medium can be accurately read from the non-volatile memory, and the information changed when the recording medium is used, can be written in and renewed, and the residual amount of the recording medium can be accurately known, and it can be rewritten in the non-volatile memory and renewed, and further, it can conduct in such a manner that, when the size of the image to be recorded, is not smaller than the residual amount of the recording medium, the recording of the image can not be conducted.

Further, according to the image recording apparatus written in the embodiment 3, the information relating to the recording medium can be accurately read in from the non-volatile memory, the information changed when the recording medium is used, can be written in and renewed, and the initial amount and used amount of the recording medium can be accurately known, and further, the used amount of the recording medium can be rewritten in the non-volatile memory and renewed, and further, it can conduct in such a manner that, when the size of the image to be recorded, is not smaller than the residual amount of the recording medium, which is known from the initial amount and used amount of the recording medium, the recording of the image can not be conducted.

Further, according to the image recording apparatus written in the embodiment 3, the information relating to the recording medium can be accurately read in from the non-volatile memory, and the information changed when the recording medium is used, can be written in and renewed, and because the color gradation of the recording image becomes appropriate to the recording medium, the recording image becomes high quality. Further, because the color correction information of the recording medium is written in the non-volatile memory and renewed, in the case where the image recording medium whose color correction is conducted already, is used again, when the color correction information is read from the non-volatile memory, it may not be necessary that the color correction is conducted again.

Figure 22:
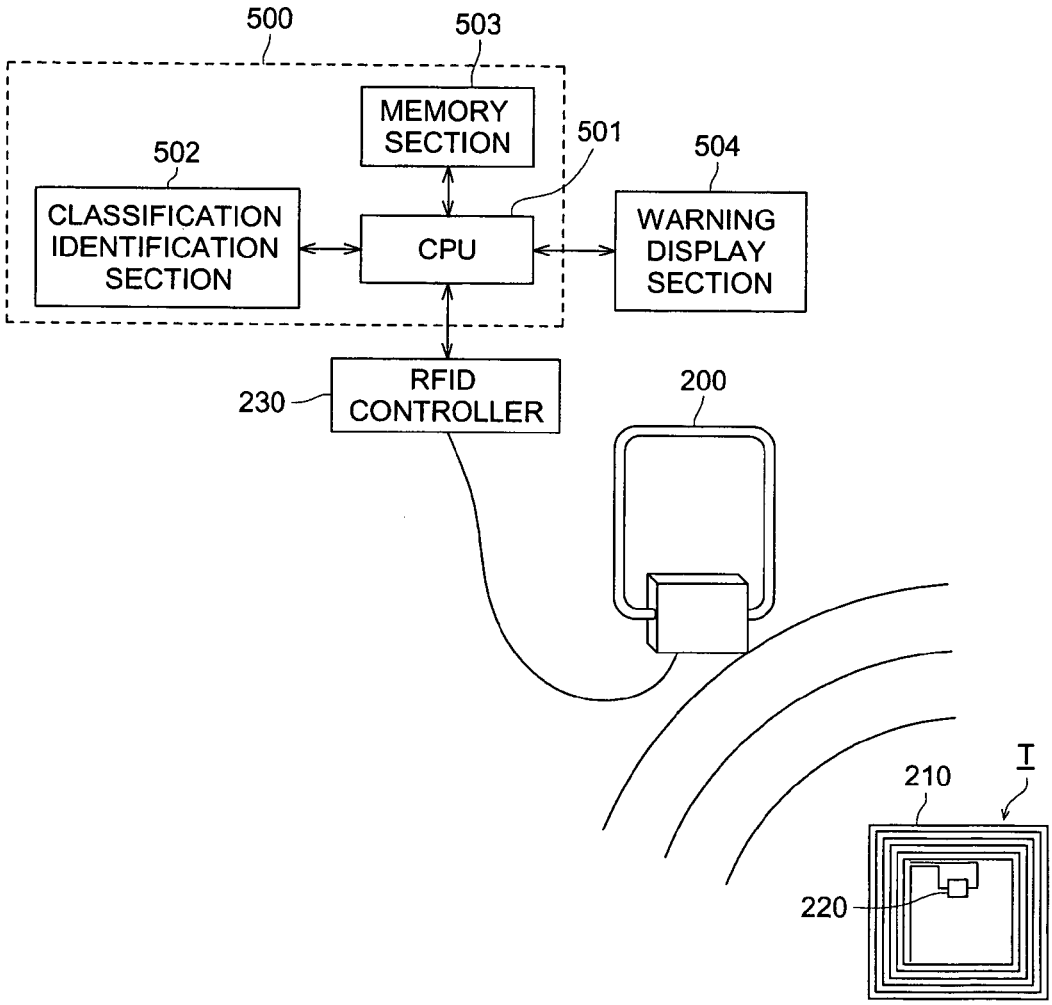
FIG. 22 is a block diagram showing the function of a transmission and reception means according to the present invention.

Next, a transmission and reception means which is another embodiment of the present invention will be described. FIG. 22 is a block diagram showing a function of the transmission and reception means according to the present invention. In the view, the wireless wave from a reader antenna 200 is received (down-link) and each kind of data stored in an IC chip 220 of the tag type transponder T which is arranged on the image recording medium side is transmitted from an antenna coil 210 (up-link). The data is read by a RFID (Radio Frequency Identification) controller 230, and outputted to a CPU 501 of a control means 500 of the inkjet recording apparatus. Herein, the tag type transponder T is composed of the RFID chip (IC chip 220) and the antenna (antenna coil 210).

A classification identification means 502 of an ink pack, recording medium roll and inkjet head calculation-processes each kind of data according to the loaded ink pack, recording medium roll and inkjet head, referring to each kind of information stored in a storing means 503 through the CPU 501, and identifies the classification such as the residual amount, quality, and characteristic, and conducts rewriting of the data stored in the recording means 503 through the CPU 501 at need.

Further, a classification identification means 502 makes the CPU 501 refer to the image formation data on the basis of the identification result of the residual amount of the ink pack and recording sheet roll, and makes the identification whether a predetermined operation can be completed, and when it is identified that the operation can not be completed, on the display input section (not shown) in the apparatus main body, or, on the display such as a PC directly connected to the apparatus or connected through an intranet, it conducts the display that "the recording sheet is insufficient for the predetermined operation" by a warning display means 504.

Tentatively, when the loaded ink pack or recording sheet roll is a product which is not adequate to the recording apparatus, and the tag type transponder T is not equipped, although they are loaded, because the data is not outputted from the RFID controller 230, the classification identification means 502 judges that the inadequate products are loaded, by the information of no-data-output from the CPU 501, and in the same manner, on the display section in the apparatus main body, or the display such as the PC directly connected to the apparatus or connected through the intranet, by the warning display means 504, it conducts the display that "It is not the ink corresponding to the present device. There is a possibility that the image quality is deteriorated."

Figure 23:
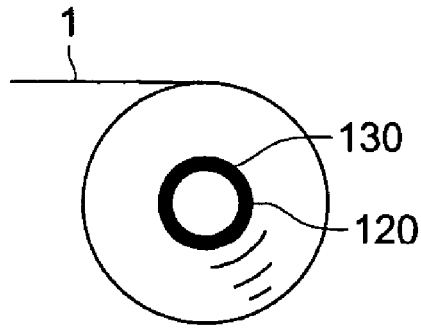
FIG. 23 is a sectional view in which the RFID film is arranged on the roller core member of the image recording medium.
Figure 24:
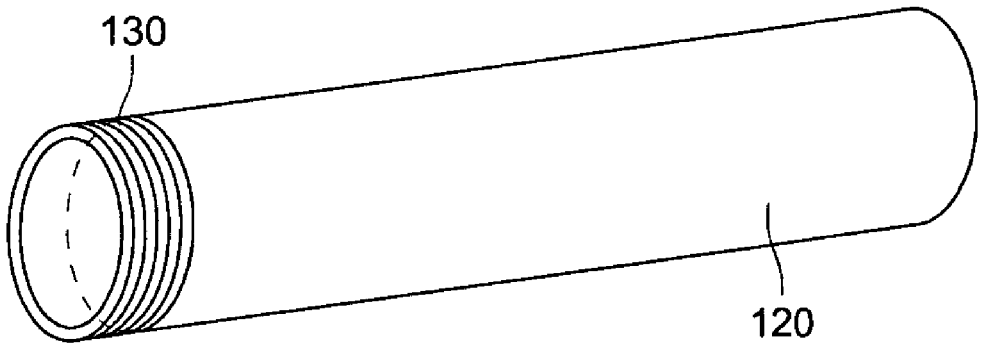
FIG. 24 is a perspective view in which the RFID film is arranged on the roller core member of the image recording medium.

Next, to realize the transmission and reception of the information relating to the image recording medium of the present embodiment, the arrangement example of the RFID means will be described. FIG. 23 is a sectional view of the image recording medium roll, and the image recording medium 1 is wound around the core member 120. The RFID film is attached to the end portion surface. FIG. 24 shows the situation that the RFID film 130 is attached to the end portion surface of the core member 120 of the image recording medium (recording sheet) roll.

FIGS. 25(*a*) to (*c*) show the RFID film before it is wound around the end portion surface of the core member 120 of the recording sheet roll and attached. In FIG. 25(*a*), an RFID chip 131 is arranged on the upper surface of the RFID film. Herein, numerals 324 and 325 are through holes for connecting a terminal of the RFID chip 131 to the antenna 132, and numerals 321*a*, 322*a*, 323*a*, 321*b*, 322*b*, 323*b* are lands to connect the antenna.

FIG. 25(*b*) is a sectional view of an RFID sheet on the upper surface of which the RFID chip is arranged, and FIG. 25(*c*) shows the rear surface of the RFID sheet on which the antenna 131 is arranged.

FIG. 26 shows a situation that the RFID sheet in FIGS. 25(*a*) to 25(*c*) is attached to the end portion surface of the core member 120 of the recording sheet roll. Herein, respective lands of 321*a* and 321*b*, 322*a* and 322*b*, 323*a* and 323*b* are connected to each other.

As described above, when the RFID chip and the antenna for RFID are arranged on the end portion surface of the recording sheet roll, the transmission and reception of the information becomes possible between the RFID chip in which the information of the image recording medium (recording sheet) is stored, and the RFID controller arranged on the image recording apparatus side. Hereupon, when the RFID chip and the antenna are arranged on the core member portion of the recording sheet roller which is an operation part, there is an advantage that the structure of the image recording medium is not constrained. That is, as the structure of the image recording medium, the structure having a fixed part (not rotated portion) for attaching the memory apparatus in which the information of the recording medium is recorded becomes not necessary. Hereupon, the arrangement method of the RFID is not limited to the above-described examples.

POSSIBILITY OF INDUSTRIAL APPLICATION

The present invention can be applied to the image recording apparatus by which the image is recorded on the image recording medium by using the recording head, and the image recording medium, and in them, it can be suitably applied to the inkjet recording apparatus by which the image is recorded on the image recording medium by using the inkjet head, and its image recording medium. When the present invention is applied to these image recording apparatus and the image recording medium, a good image can be always offered under the preferable condition, and further, the image recording apparatus and image reading medium which are user-friendly for the user, can be offered.

The invention claimed is:

1. An image recording apparatus for recording an image on an image recording medium, comprising:

a recording head for jetting ink onto the recording medium;

a transport section for transporting the recording medium;

a heating and pressing section for at least one of heating and pressing on the recording medium after the jetting of the ink;

an information reading section for reading information from an information recording section, which is provided on the image recording medium, and in which information relating to the image recording medium is recorded; and a controller for controlling an operating condition of the image recording apparatus based on the information read by the information reading section;

wherein the information relating to the image recording medium comprises information of at least one of a heating and pressing condition of the image recording medium, and the operation condition controlled by the controller comprises the at least one of the heating and pressing condition.

2. An image recording apparatus for recording an image on an image recording medium, comprising:

a recording head for jetting ink onto the recording medium;

a transport section for transporting the recording medium;

an information reading section for reading information from an information recording section, which is provided on the image recording medium, and in which information relating to the image recording medium is recorded; and a controller for controlling an operating condition of the image recording apparatus based on the information read by the information reading section;

wherein the information relating to the image recording medium comprises information of an ink absorption speed of the image recording medium, and the operating condition controlled by the controller comprises a recording interval time when the image recording is continuously conducted.

3. An image recording apparatus for recording an image on an image recording medium, comprising:

a recording head for jetting ink onto the recording medium;

a transport section for transporting the recording medium;

an information reading section for reading information from an information recording section, which is provided on the image recording medium, and in which information relating to the image recording medium is recorded; and a controller for controlling an operating condition of the image recording apparatus based on the information read by the information reading section;

wherein the information relating to the image recording medium comprises information of ink dot diameter, and the operating condition controlled by the controller comprises an ink jetting amount per unit area.

4. An image recording apparatus for recording an image on an image recording medium, comprising:

a recording head for jetting ink onto the recording medium;

a transport section for transporting the recording medium;

an information reading section for reading information from an information recording section, which is provided on the image recording medium, and in which information relating to the image recording medium is recorded; and a controller for controlling an operating condition of the image recording apparatus based on the information read by the information reading section;

wherein the information relating to the image recording medium comprises information of drying time of the image recording medium, and the operating condition controlled by the controller comprises a recording interval time when the image recording is continuously conducted.

5. An image recording apparatus for recording an image on an image recording medium, comprising:

a recording head for jetting ink onto the recording medium;

a transport section for transporting the recording medium;

an information reading section for reading information from an information recording section, which is provided on the image recording medium, and in which information of color correction data of the recording medium is recorded;

a color correction section for generating renewed color correction data by referring to the information of color correction data read by the information reading section;

a color gradation transform section for transforming a color gradation of a recording image on the recording medium; and a controller which controls the color gradation transform section to transform the color gradation of the recording image based on the renewed color correction data.

6. The image recording apparatus according to claim 5, wherein the information recording section comprises a nonvolatile memory.

7. The image recording apparatus according to claim 6, wherein the image recording section comprises a RFID.

8. The image recording apparatus according to claim 6, further comprising a rewriting section for rewriting the color correction data recorded in the nonvolatile memory, based on the renewed color correction data.

9. An image recording apparatus for recording an image on an image recording medium, comprising:

a recording head for jetting ink onto the recording medium;

a transport section for transporting the recording medium;

an information reading section for reading information from an information recording section, which is provided on the image recording medium, and in which information relating to the image recording medium is recorded; and a controller for controlling an operating condition of the image recording apparatus based on the information read by the information reading section;

wherein the controller determines whether the image recording medium is adapted for use in the image recording apparatus based on the information relating to the image recording medium, and controls the image recording apparatus not to record the image on the image recording medium when the controller determines that the image recording medium is not adapted for use in the image recording apparatus.

10. The image recording apparatus according to claim 9, wherein the information recording section comprises a nonvolatile memory.

* * * * *